US009999812B2

(12) United States Patent
Oldknow et al.

(10) Patent No.: US 9,999,812 B2
(45) **Date of Patent: *Jun. 19, 2018**

(54) GOLF CLUB HEAD OR OTHER BALL STRIKING DEVICE HAVING IMPACT-INFLUENCING BODY FEATURES

(71) Applicant: NIKE, Inc., Beaverton, OR (US)

(72) Inventors: Andrew G. V. Oldknow, Beaverton, OR (US); Robert M. Boyd, Flower Mound, TX (US); John T. Stites, Sallisaw, OK (US); Rick S. Wahlin, Keller, TX (US)

(73) Assignee: NIKE, Inc., Beaverton, OR (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 14/724,471

(22) Filed: May 28, 2015

(65) Prior Publication Data

US 2015/0258395 A1 Sep. 17, 2015

Related U.S. Application Data

(63) Continuation of application No. 14/169,783, filed on Jan. 31, 2014, now Pat. No. 9,278,265, which is a (Continued)

(51) Int. Cl.

| | |
|---|---|
| ***A63B 53/04*** | (2015.01) |
| ***A63B 53/06*** | (2015.01) |
| *A63B 60/52* | (2015.01) |

(52) U.S. Cl.

CPC ..... *A63B 53/0466* (2013.01); *A63B 53/04* (2013.01); *A63B 60/52* (2015.10); (Continued)

(58) Field of Classification Search

CPC ..... A63B 53/0466; A63B 53/04; A63B 2053/0412; A63B 2053/0433; (Continued)

(56) References Cited

U.S. PATENT DOCUMENTS

| | | | |
|---|---|---|---|
| 632,885 | A | 9/1899 | Sweny |
| 777,400 | A | 12/1904 | Clark |

(Continued)

FOREIGN PATENT DOCUMENTS

| | | | |
|---|---|---|---|
| FR | 2672226 | A1 | 8/1992 |
| GB | 2280380 | A | 2/1995 |
| GB | 2388792 | A | 11/2003 |
| JP | H0639036 | U | 5/1994 |
| JP | H06190088 | A | 7/1994 |
| JP | 3035480 | U | 3/1997 |
| JP | 11114102 | | 6/2000 |
| JP | 2000176056 | A | 6/2000 |

(Continued)

OTHER PUBLICATIONS

"Photographs 1, 2 and 3", presented in U.S. Appl. No. 12/842,650, of unknown source, taken after the filing date of the U.S. Appl. No. 12/842,650, depicting a golf club product; presented to the Patent Office for consideration on Oct. 7, 2011.

(Continued)

*Primary Examiner* — Sebastiano Passaniti
(74) *Attorney, Agent, or Firm* — Banner & Witcoff, Ltd.

(57) ABSTRACT

A ball striking device, such as a golf club, includes a head with a face having an outer surface configured for striking a ball, a body connected to the face, and a channel located in the body. The channel is configured to influence the characteristics of the impact of a ball on the face, such as by flexing or compressing in response to the force of the impact, exerting a response or reaction force on the face, changing the motion or behavior of the face, and other manners. The head may also include a pair of channels that have a gap between them.

20 Claims, 8 Drawing Sheets

Related U.S. Application Data continuation of application No. 13/567,589, filed on Aug. 6, 2012, now Pat. No. 8,641,555, which is a continuation of application No. 12/842,650, filed on Jul. 23, 2010, now Pat. No. 8,235,841.

(60) Provisional application No. 61/228,500, filed on Jul. 24, 2009.

(52) U.S. Cl.
CPC ..... *A63B 2053/0408* (2013.01); *A63B 2053/0412* (2013.01); *A63B 2053/0416* (2013.01); *A63B 2053/0433* (2013.01); *A63B 2053/0437* (2013.01); *A63B 2053/0441* (2013.01); *A63B 2209/00* (2013.01)

(58) Field of Classification Search
CPC ..... A63B 2209/00; A63B 2053/0416; A63B 2053/0408; A63B 2053/0441; A63B 60/52; A63B 2053/0437
USPC ..... 473/324–350, 287–292
See application file for complete search history.

(56) References Cited

U.S. PATENT DOCUMENTS 1,705,997 A 3/1929 Williams
1,854,548 A 4/1932 Hunt
2,087,685 A 7/1937 Hackney
2,429,351 A 10/1947 Fetterolf
2,550,846 A 5/1951 Milligan
2,968,486 A 1/1961 Walton
3,061,310 A 10/1962 Giza
3,064,980 A 11/1962 Steiner
3,810,631 A 5/1974 Braly
3,814,437 A 6/1974 Winquist
3,997,170 A 12/1976 Goldberg
4,313,607 A 2/1982 Thompson
4,322,083 A 3/1982 Imai
4,664,383 A 5/1987 Aizawa
4,681,321 A 7/1987 Chen et al.
4,928,972 A 5/1990 Nakanishi et al.
5,028,049 A 7/1991 McKeighen
5,067,715 A 11/1991 Schmidt et al.
5,186,465 A 2/1993 Chorne
5,205,560 A 4/1993 Hoshi et al.
5,282,625 A 2/1994 Schmidt et al.
5,290,036 A 3/1994 Fenton et al.
5,316,305 A 5/1994 McCabe
5,333,871 A 8/1994 Wishon
5,346,216 A 9/1994 Aizawa
5,419,556 A * 5/1995 Take ..... A63B 53/04 473/324
5,419,560 A 5/1995 Bamber
5,433,441 A 7/1995 Olsen et al.
5,447,307 A 9/1995 Antonious
5,451,056 A 9/1995 Manning
5,464,217 A 11/1995 Shenoha et al.
5,467,988 A 11/1995 Henwood
5,472,201 A 12/1995 Aizawa et al.
5,472,203 A 12/1995 Schmidt et al.
5,492,327 A 2/1996 Biafore, Jr.
5,497,995 A 3/1996 Swisshelm
5,505,453 A 4/1996 Mack
5,516,106 A 5/1996 Henwood
D371,817 S 7/1996 Olsaysky et al.
5,547,427 A 8/1996 Rigal et al.
D375,130 S 10/1996 Hlinka et al.
5,570,886 A 11/1996 Rigal et al.
5,584,770 A 12/1996 Jensen
5,586,948 A 12/1996 Mick
5,595,552 A 1/1997 Wright et al.
5,603,668 A 2/1997 Antonious
5,607,365 A 3/1997 Wolf
5,692,972 A 12/1997 Langslet
5,749,795 A 5/1998 Schmidt et al.
5,785,609 A 7/1998 Sheets et al.
5,803,830 A 9/1998 Austin et al.
5,863,261 A 1/1999 Eggiman
5,971,868 A 10/1999 Kosmatka
5,993,329 A 11/1999 Shieh
6,001,030 A 12/1999 Delaney
6,042,486 A 3/2000 Gallagher
6,048,278 A 4/2000 Meyer et al.
6,086,485 A 7/2000 Hamada et al.
6,149,534 A 11/2000 Peters et al.
6,159,109 A 12/2000 Langslet
6,193,614 B1 2/2001 Sasamoto et al.
6,217,461 B1 4/2001 Galy
6,302,807 B1 10/2001 Rohrer
6,319,150 B1 11/2001 Werner et al.
6,332,848 B1 12/2001 Long et al.
6,338,683 B1 1/2002 Kosmatka
6,344,000 B1 2/2002 Hamada et al.
6,344,001 B1 2/2002 Hamada et al.
6,354,961 B1 3/2002 Allen
RE37,647 E 4/2002 Wolf
6,368,232 B1 4/2002 Hamada et al.
6,368,234 B1 4/2002 Galloway
6,422,951 B1 7/2002 Burrows
6,443,857 B1 9/2002 Chuang
6,605,007 B1 8/2003 Bissonnette et al.
6,607,451 B2 8/2003 Kosmatka et al.
D482,089 S 11/2003 Burrows
D482,090 S 11/2003 Burrows
D482,420 S 11/2003 Burrows
6,652,391 B1 11/2003 Kubica et al.
D484,208 S 12/2003 Burrows
6,663,503 B1 12/2003 Kenmi
6,663,506 B2 12/2003 Nishimoto et al.
6,688,989 B2 2/2004 Best
6,719,645 B2 4/2004 Kouno
6,783,465 B2 8/2004 Matsunaga
6,800,037 B2 10/2004 Kosmatka
6,800,038 B2 10/2004 Willett et al.
6,800,039 B1 10/2004 Tseng
D501,036 S 1/2005 Burrows
D501,523 S 2/2005 Dogan et al.
6,899,638 B2 5/2005 Iwata et al.
6,926,618 B2 8/2005 Sanchez et al.
6,960,142 B2 11/2005 Bissonnette et al.
6,991,560 B2 1/2006 Tseng
7,018,303 B2 3/2006 Yamamoto
7,041,003 B2 5/2006 Bissonnette et al.
7,048,646 B2 5/2006 Yamanaka et al.
D524,392 S 7/2006 Madore et al.
7,070,513 B2 7/2006 Takeda et al.
7,086,964 B2 8/2006 Chen et al.
7,097,572 B2 8/2006 Yabu
7,137,907 B2 11/2006 Gibbs et al.
7,140,974 B2 11/2006 Chao et al.
7,140,975 B2 11/2006 Bissonnette et al.
7,163,468 B2 1/2007 Gibbs et al.
7,169,059 B2 1/2007 Rice et al.
7,175,541 B2 2/2007 Lo
7,192,364 B2 3/2007 Long
7,207,898 B2 4/2007 Rice et al.
7,211,006 B2 5/2007 Chang
7,247,104 B2 7/2007 Poynor
7,255,653 B2 8/2007 Saso
7,258,631 B2 8/2007 Galloway et al.
7,261,643 B2 8/2007 Rice et al.
7,278,926 B2 10/2007 Frame
7,318,782 B2 1/2008 Imamoto et al.
7,344,452 B2 3/2008 Imamoto et al.
7,347,795 B2 3/2008 Yamagishi et al.
7,367,898 B2 5/2008 Hawkins et al.
7,387,579 B2 6/2008 Lin et al.
7,396,293 B2 7/2008 Soracco
7,438,649 B2 10/2008 Ezaki et al.
7,445,563 B1 11/2008 Werner
7,470,201 B2 12/2008 Nakahara et al.
7,473,186 B2 1/2009 Best et al.

(56) References Cited

U.S. PATENT DOCUMENTS

| | | | | |
|---|---|---|---|---|
| 7,476,161 | B2 | 1/2009 | Williams et al. | |
| 7,494,426 | B2 | 2/2009 | Nishio et al. | |
| 7,500,924 | B2 | 3/2009 | Yokota | |
| 7,530,901 | B2 * | 5/2009 | Imamoto | A63B 53/0466 473/334 |
| 7,563,176 | B2 | 7/2009 | Roberts et al. | |
| 7,572,193 | B2 * | 8/2009 | Yokota | A63B 53/0466 473/328 |
| 7,575,523 | B2 | 8/2009 | Yokota | |
| 7,582,024 | B2 | 9/2009 | Shear | |
| 7,585,233 | B2 | 9/2009 | Horacek et al. | |
| 7,618,331 | B2 | 11/2009 | Hirano | |
| 7,641,569 | B2 | 1/2010 | Best et al. | |
| 7,717,807 | B2 | 5/2010 | Evans et al. | |
| D616,952 | S | 6/2010 | Oldknow | |
| 7,749,101 | B2 | 7/2010 | Imamoto et al. | |
| 7,753,809 | B2 | 7/2010 | Cackett et al. | |
| 7,824,277 | B2 | 11/2010 | Bennett et al. | |
| 7,837,577 | B2 | 11/2010 | Evans | |
| 7,857,711 | B2 | 12/2010 | Shear | |
| 7,931,545 | B2 | 4/2011 | Soracco et al. | |
| 7,938,739 | B2 | 5/2011 | Cole et al. | |
| 7,959,523 | B2 | 6/2011 | Rae et al. | |
| 7,988,565 | B2 | 8/2011 | Abe | |
| 7,997,999 | B2 | 8/2011 | Roach et al. | |
| 8,012,041 | B2 | 9/2011 | Gibbs et al. | |
| 8,043,168 | B2 | 10/2011 | Cackett et al. | |
| 8,172,697 | B2 | 5/2012 | Cackett et al. | |
| 8,187,116 | B2 | 5/2012 | Boyd et al. | |
| 8,206,241 | B2 | 6/2012 | Boyd et al. | |
| 8,235,841 | B2 * | 8/2012 | Stites | A63B 53/0466 473/328 |
| 8,235,844 | B2 | 8/2012 | Albertsen et al. | |
| 8,241,143 | B2 | 8/2012 | Albertsen et al. | |
| 8,241,144 | B2 | 8/2012 | Albertsen et al. | |
| 8,251,834 | B2 | 8/2012 | Curtis et al. | |
| 8,257,195 | B1 | 9/2012 | Erickson | |
| 8,277,337 | B2 | 10/2012 | Shimazaki | |
| 8,282,506 | B1 | 10/2012 | Holt | |
| 8,328,659 | B2 | 12/2012 | Shear | |
| 8,333,668 | B2 | 12/2012 | De La Cruz et al. | |
| 8,337,325 | B2 | 12/2012 | Boyd et al. | |
| 8,353,782 | B1 | 1/2013 | Beach et al. | |
| 8,353,786 | B2 | 1/2013 | Beach et al. | |
| 8,403,771 | B1 | 3/2013 | Rice et al. | |
| 8,435,134 | B2 | 5/2013 | Tang et al. | |
| 8,517,860 | B2 | 8/2013 | Albertsen et al. | |
| 8,529,368 | B2 | 9/2013 | Rice et al. | |
| 8,579,728 | B2 | 11/2013 | Morales et al. | |
| 8,591,351 | B2 | 11/2013 | Albertsen et al. | |
| 8,591,353 | B1 | 11/2013 | Honea et al. | |
| 8,632,419 | B2 | 1/2014 | Tang et al. | |
| 8,641,555 | B2 * | 2/2014 | Stites | A63B 53/0466 473/328 |
| 8,663,027 | B2 | 3/2014 | Morales et al. | |
| 8,821,312 | B2 | 9/2014 | Burnett et al. | |
| 8,827,831 | B2 | 9/2014 | Burnett et al. | |
| 8,827,836 | B2 | 9/2014 | Thomas | |
| 8,834,289 | B2 | 9/2014 | de la Cruz et al. | |
| 8,834,290 | B2 | 9/2014 | Bezilla et al. | |
| 8,845,454 | B2 | 9/2014 | Boyd et al. | |
| D714,893 | S | 10/2014 | Atwell | |
| 8,858,360 | B2 | 10/2014 | Rice et al. | |
| 8,870,679 | B2 | 10/2014 | Oldknow | |
| D722,122 | S | 2/2015 | Greensmith | |
| 8,986,133 | B2 | 3/2015 | Bennett et al. | |
| 9,101,808 | B2 | 8/2015 | Stites et al. | |
| 9,278,265 | B2 * | 3/2016 | Oldknow | A63B 53/0466 |
| 2002/0019265 | A1 | 2/2002 | Allen | |
| 2002/0055396 | A1 | 5/2002 | Nishimoto et al. | |
| 2002/0183134 | A1 | 12/2002 | Allen et al. | |
| 2003/0013545 | A1 | 1/2003 | Vincent et al. | |
| 2003/0045371 | A1 | 3/2003 | Wood et al. | |
| 2003/0130059 | A1 | 7/2003 | Billings | |
| 2004/0121852 | A1 | 6/2004 | Tsurumaki | |
| 2004/0176183 | A1 | 9/2004 | Tsurumaki | |
| 2004/0192463 | A1 | 9/2004 | Tsurumaki et al. | |
| 2004/0219991 | A1 | 11/2004 | Suprock et al. | |
| 2005/0032586 | A1 | 2/2005 | Willett et al. | |
| 2005/0119070 | A1 | 6/2005 | Kumamoto | |
| 2005/0124435 | A1 | 6/2005 | Gambetta et al. | |
| 2005/0215350 | A1 | 9/2005 | Reyes et al. | |
| 2006/0019770 | A1 | 1/2006 | Meyer et al. | |
| 2006/0046868 | A1 | 3/2006 | Murphy | |
| 2006/0068932 | A1 | 3/2006 | Rice et al. | |
| 2006/0073910 | A1 | 4/2006 | Imamoto et al. | |
| 2006/0079349 | A1 | 4/2006 | Rae et al. | |
| 2006/0084525 | A1 | 4/2006 | Imamoto et al. | |
| 2006/0094531 | A1 | 5/2006 | Bissonnette et al. | |
| 2006/0189407 | A1 | 8/2006 | Soracco | |
| 2006/0194644 | A1 | 8/2006 | Nishio | |
| 2007/0021234 | A1 | 1/2007 | Tsurumaki et al. | |
| 2007/0026961 | A1 | 2/2007 | Hou | |
| 2007/0049400 | A1 | 3/2007 | Imamoto et al. | |
| 2007/0049407 | A1 | 3/2007 | Tateno et al. | |
| 2007/0049415 | A1 | 3/2007 | Shear | |
| 2007/0049417 | A1 | 3/2007 | Shear | |
| 2007/0082751 | A1 | 4/2007 | Lo et al. | |
| 2007/0117648 | A1 | 5/2007 | Yokota | |
| 2007/0149309 | A1 | 6/2007 | Ford | |
| 2007/0238551 | A1 | 10/2007 | Yokota | |
| 2008/0015047 | A1 | 1/2008 | Rice et al. | |
| 2008/0064523 | A1 | 3/2008 | Chen | |
| 2008/0125244 | A1 | 5/2008 | Meyer et al. | |
| 2008/0182682 | A1 | 7/2008 | Rice et al. | |
| 2009/0075751 | A1 | 3/2009 | Gilbert et al. | |
| 2009/0098949 | A1 | 4/2009 | Chen | |
| 2009/0163294 | A1 | 6/2009 | Cackett et al. | |
| 2009/0286611 | A1 | 11/2009 | Beach et al. | |
| 2010/0016095 | A1 | 1/2010 | Burnett et al. | |
| 2010/0029408 | A1 | 2/2010 | Abe | |
| 2010/0056298 | A1 | 3/2010 | Jertson et al. | |
| 2010/0292024 | A1 | 11/2010 | Hagood et al. | |
| 2011/0021284 | A1 | 1/2011 | Stites et al. | |
| 2011/0118051 | A1 | 5/2011 | Thomas | |
| 2011/0151997 | A1 | 6/2011 | Shear | |
| 2011/0218053 | A1 | 9/2011 | Tang et al. | |
| 2011/0256954 | A1 | 10/2011 | Soracco | |
| 2011/0294599 | A1 | 12/2011 | Albertsen et al. | |
| 2012/0083362 | A1 | 4/2012 | Albertsen et al. | |
| 2012/0122601 | A1 | 5/2012 | Beach et al. | |
| 2012/0142447 | A1 | 6/2012 | Boyd et al. | |
| 2012/0142452 | A1 | 6/2012 | Burnett et al. | |
| 2012/0196701 | A1 | 8/2012 | Stites et al. | |
| 2012/0277029 | A1 | 11/2012 | Albertsen et al. | |
| 2012/0277030 | A1 | 11/2012 | Albertsen et al. | |
| 2013/0065705 | A1 | 3/2013 | Morales et al. | |
| 2013/0165254 | A1 | 6/2013 | Rice et al. | |
| 2014/0080627 | A1 | 3/2014 | Bennett et al. | |
| 2015/0217167 | A1 | 8/2015 | Frame et al. | |

FOREIGN PATENT DOCUMENTS

| | | | |
|---|---|---|---|
| JP | 2002052099 | A | 2/2002 |
| JP | 2002248183 | A | 9/2002 |
| JP | 2003093554 | A | 4/2003 |
| JP | 2004351054 | A | 12/2004 |
| JP | 2004351173 | A | 12/2004 |
| JP | 3115147 | U | 11/2005 |
| JP | 2006231063 | | 9/2006 |
| JP | 2007136069 | A | 6/2007 |
| JP | 2008200118 | | 9/2008 |
| JP | 2010279847 | A | 12/2010 |
| JP | 2011024999 | A | 2/2011 |
| WO | 2011153067 | A1 | 12/2011 |

OTHER PUBLICATIONS

Nov. 26, 2010—(WO) International Search Report and Written Opinion App. No. PCT/US2010/043073.

* cited by examiner

GOLF CLUB HEAD OR OTHER BALL STRIKING DEVICE HAVING IMPACT-INFLUENCING BODY FEATURES

CROSS-REFERENCE TO RELATED APPLICATIONS

This application is a continuation of co-pending U.S. patent application Ser. No. 14/169,783, filed Jan. 31, 2014, which is a continuation of U.S. patent application Ser. No. 13/567,589, filed Aug. 6, 2012, and issued as U.S. Pat. No. 8,641,555 on Feb. 4, 2014, which is a continuation of U.S. patent application Ser. No. 12/842,650, filed Jul. 23, 2010, and issued as U.S. Pat. No. 8,235,841 on Aug. 7, 2012, which claims priority to and the benefit of U.S. Provisional Patent Application No. 61/228,500, filed Jul. 24, 2009, all of which prior applications are incorporated herein by reference in their entireties and made part hereof.

BACKGROUND

Golf is enjoyed by a wide variety of players—players of different genders, and players of dramatically different ages and skill levels. Golf is somewhat unique in the sporting world in that such diverse collections of players can play together in golf outings or events, even in direct competition with one another (e.g., using handicapped scoring, different tee boxes, etc.), and still enjoy the golf outing or competition. These factors, together with increased golf programming on television (e.g., golf tournaments, golf news, golf history, and/or other golf programming) and the rise of well known golf superstars, at least in part, have increased golfs popularity in recent years, both in the United States and across the world.

Golfers at all skill levels seek to improve their performance, lower their golf scores, and reach that next performance "level." Manufacturers of all types of golf equipment have responded to these demands, and recent years have seen dramatic changes and improvements in golf equipment. For example, a wide range of different golf ball models now are available, with some balls designed to fly farther and straighter, provide higher or flatter trajectory, provide more spin, control, and feel (particularly around the greens), etc.

Being the sole instrument that sets a golf ball in motion during play, the golf club also has been the subject of much technological research and advancement in recent years. For example, the market has seen improvements in golf club heads, shafts, and grips in recent years. Additionally, other technological advancements have been made in an effort to better match the various elements of the golf club and characteristics of a golf ball to a particular user's swing features or characteristics (e.g., club fitting technology, ball launch angle measurement technology, etc.).

Despite the various technological improvements, golf remains a difficult game to play at a high level. For a golf ball to reliably fly straight and in the desired direction, a golf club must meet the golf ball square (or substantially square) to the desired target path. Moreover, the golf club must meet the golf ball at or close to a desired location on the club head face (i.e., on or near a "desired" or "optimal" ball contact location) to reliably fly straight, in the desired direction, and for a desired distance. Off-center hits may tend to "twist" the club face when it contacts the ball, thereby sending the ball in the wrong direction, imparting undesired hook or slice spin, and/or robbing the shot of distance. Club face/ball contact that deviates from squared contact and/or is located away from the club's desired ball contact location, even by a relatively minor amount, also can launch the golf ball in the wrong direction, often with undesired hook or slice spin, and/or can rob the shot of distance. The distance and direction of ball flight can also be significantly affected by the spin imparted to the ball by the impact with the club head. Various golf club heads have been designed to improve a golfer's accuracy by assisting the golfer in squaring the club head face at impact with a golf ball.

The energy or velocity transferred to the ball by a golf club also may be related, at least in part, to the flexibility of the club face at the point of contact, and can be expressed using a measurement called "coefficient of restitution" (or "COR"). The maximum COR for golf club heads is currently limited by the USGA at 0.83. Generally, a club head will have an area of highest response relative to other areas of the face, such as having the highest COR, which imparts the greatest energy and velocity to the ball, and this area is typically positioned at the center of the face. In one example, the area of highest response may have a COR that is equal to the prevailing USGA limit (e.g. 0.83), which may change over time. However, because golf clubs are typically designed to contact the ball at or around the center of the face, off-center hits may result in less energy being transferred to the ball, decreasing the distance of the shot.

The flexing behavior of the ball striking face and/or other portions of the head during impact can also influence the energy and velocity transferred to the ball, the direction of ball flight after impact, and the spin imparted to the ball, among other factors. Accordingly, a need exists to alter and/or improve the deformation of the ball striking face and/or other portions of the head during impact. The flexing or deformation behavior of the ball itself during impact can also influence some or all of these factors. Certain characteristics of the face and/or other portions of the head during impact can also have an effect on the deformation of the ball. Accordingly, a need also exists to provide a ball striking head with features that cause altered and/or improved deformation behavior of the ball during impacts with the ball striking face of the head.

The interaction between the club head and the playing surface can also affect the distance and accuracy of a golf shot, particularly with clubs such as fairway woods, hybrid clubs, irons, and putters, which are designed for hitting a ball resting directly on the playing surface. Drag created by friction between the sole of the club head and the playing surface can reduce the speed of the swing and the resultant velocity and distance of the shot. Additionally, forces between the club head and the playing surface can twist or otherwise alter the direction or orientation of the club head during the swing, which can also reduce distance, velocity, and accuracy, as well as imparting unwanted spin on the ball. Accordingly, a need also exists to provide a ball striking head with features that reduce drag and other forces between the club head and the playing surface during a swing.

The present device and method are provided to address the problems discussed above and other problems, and to provide advantages and aspects not provided by prior ball striking devices of this type. A full discussion of the features and advantages of the present invention is deferred to the following detailed description, which proceeds with reference to the accompanying drawings.

BRIEF SUMMARY

The following presents a general summary of aspects of the invention in order to provide a basic understanding of the invention. This summary is not an extensive overview of the invention. It is not intended to identify key or critical elements of the invention or to delineate the scope of the invention. The following summary merely presents some concepts of the invention in a general form as a prelude to the more detailed description provided below.

Aspects of the invention relate to ball striking devices, such as golf clubs, with a head that includes a face configured for striking a ball and a body connected to the face, the body being adapted for connection of a shaft thereto. Various example structures of heads described herein include a face having a ball striking surface configured for striking a ball, a body connected to the face and extending rearward from the face, and first and second inwardly recessed channels located on the body and configured to influence the impact of a ball on the face. The body includes a heel, a toe, a top side, and a sole configured to confront a playing surface in use. The first and second channels are at least partially located on the sole of the body. The first channel is elongated between a proximal end located proximate a center of the sole and a distal end located more proximate the heel, and the second channel is elongated between a proximal end located proximate the center of the sole and a distal end located more proximate the toe. Additionally, a gap is defined proximate the center of the sole between the proximal ends of the first and second channels.

According to one aspect, the channels are configured to flex and compress upon impact of the ball on the face. The channels may further be configured to exert a response force on the face upon impact of the ball on the face and to force a bottom edge of the face outwardly upon impact of the ball on the face.

According to another aspect, the sole further includes a keel positioned along the center of the sole and extending rearward from a bottom edge of the face toward a rear of the head opposite the face. The keel is configured to be a lowest surface of the head in use, and at least a portion of the keel is raised with respect to adjacent surfaces of the sole, such that the keel is located at least partially within the gap.

According to a further aspect, at least a portion of the first channel and at least a portion of the second channel are elongated along directions of elongation generally parallel to a bottom edge of the face and are spaced rearwardly from the bottom edge of the face. Additionally, at least a portion of the first channel and at least a portion of the second channel may extend toward each other along the directions of elongation.

According to yet another aspect, each of the first and second channels is defined by a boundary edge, and each of the first and second channels is recessed inwardly from the boundary edge thereof.

Additional aspects of the invention relate to a golf club head that includes a face having an outer surface configured for striking a ball and defined by a plurality of peripheral edges, a body connected to the face and extending rearward from the face, and two inwardly recessed channels located on the body and being configured to influence the impact of a ball on the face. The body includes a heel, a toe, a top side, and a sole configured to confront a playing surface in use. The first channel is elongated along a direction of elongation that is generally parallel to at least one of the peripheral edges of the face between a first end and a second end, and the second channel is also elongated along a direction of elongation that is generally parallel to at least one peripheral edge of the face between a first end and a second end. A gap is defined between the first end of the first channel and the first end of the second channel.

According to one aspect, the first and second channels are configured to flex and compress upon impact of the ball on the face, and the channels are further configured to exert a response force on the face upon impact of the ball on the face and to force a bottom edge of the face outwardly upon impact of the ball on the face.

According to another aspect, at least a portion of the first channel and at least a portion of the second channel are located on the sole, and at least a portion of the gap is located proximate a center of the sole.

According to a further aspect, the body further comprises a keel positioned along a center of the sole and extending rearward from a bottom edge of the face toward a rear of the head opposite the face, wherein the keel is configured to be a lowest surface of the head in use, and at least a portion of the keel is raised with respect to adjacent surfaces of the sole, and wherein the keel is located at least partially within the gap.

According to yet another aspect, the first channel and the second channel each have at least a portion that is elongated along a direction of elongation generally parallel to a bottom peripheral edge of the face and is spaced rearwardly from the bottom peripheral edge of the face.

Further aspects of the invention relate to a golf club head that includes a face having an outer surface configured for striking a ball and defined by a plurality of peripheral edges, a body connected to the face and extending rearward from the face, and an inwardly recessed channel located on the body and being configured to influence the impact of a ball on the face. The body includes a heel, a toe, a top side, and a sole configured to confront a playing surface in use. The channel is elongated along a direction of elongation that is generally parallel to at least one of the peripheral edges of the face, and the channel does not extend across a center portion of the sole that is configured to be a lowest surface of the head in use.

According to one aspect, the channel has at least a portion that is elongated along a direction of elongation generally parallel to a bottom peripheral edge of the face and is spaced rearwardly from the bottom peripheral edge of the face.

According to another aspect, a second channel may be located on the body and may be configured to influence the impact of a ball on the face. Such a second channel may be elongated along a direction of elongation that is generally parallel to at least one of the peripheral edges of the face, such that a gap is defined between an end of the channel and an end of the second channel.

Still further aspects of the invention relate to a fairway wood golf club head that includes a face having an outer surface configured for striking a ball and defined by a plurality of peripheral edges including a bottom edge, a fairway wood body connected to the face and extending rearward from the face to define an internal volume between the body and the face, and first and second inwardly recessed channels at least partially located on the sole of the body and being configured to influence the impact of a ball on the face. The outer surface of the face has a loft angle of between about 12 and 32 degrees, and the body includes a heel, a toe, a top side, and a sole configured to confront a playing surface in use. The first channel is elongated in a direction generally parallel to at least the bottom edge of the face, between a proximal end located proximate a center of the sole and a distal end located more proximate the heel, and the second channel is elongated in a direction generally parallel to at least the bottom edge of the face, between a proximal end located proximate the center of the sole and a distal end located more proximate the toe. The first channel and the second channel are each defined by boundary edges, and each of the first and second channels are recessed from the boundary edges. A gap is defined proximate the center of the sole between the proximal ends of the first and second channels.

According to one aspect, a spacing portion of the sole is positioned between the first and second channels and the bottom edge of the face.

According to another aspect, the loft angle may be different. For example, in one example fairway wood club head, the loft angle is between 15 and 28 degrees.

According to a further aspect, the first and second channels are elongated in directions extending toward each other.

According to yet another aspect, the sole further includes a keel positioned along a center of the sole and extending rearward from the bottom edge of the face toward a rear of the head opposite the face. The keel is configured to be a lowest surface of the head in use, and at least a portion of the keel is raised with respect to adjacent surfaces of the sole.

According to a still further aspect, the keel may have a substantially smooth curvilinear surface, or may have a plurality of substantially smooth, substantially planar surfaces oriented at oblique angles to each other.

Other aspects of the invention relate to a golf club head including a face having an outer surface configured for striking a ball and defined by a plurality of peripheral edges including a bottom edge, a body connected to the face and extending rearward from the face, and an inwardly recessed channel extending across at least a portion of the body. The body includes a heel, a toe, a top side, and a sole configured to confront a playing surface in use. The sole includes a keel positioned along a center of the sole and extending rearward from the bottom edge of the face toward a rear of the head opposite the face. At least a portion of the keel is raised with respect to adjacent surfaces of the sole, such that the keel is configured to be a lowest surface of the head in use. Additionally, the keel includes a plurality of substantially planar surfaces that are adjoined to each other along juncture lines and arranged at oblique angles to one another. The channel is recessed from the keel, and the channel does not extend completely across the keel.

According to one aspect, the substantially planar surfaces are adjoined to each other along a plurality of juncture lines, forming a center ridge adapted to form the lowest point on the head when the golf club is in use.

According to another aspect, the substantially planar surfaces include a first surface, a second surface, a third surface, and a fourth surface adjoined to each other to share a common convergence point. In one embodiment, the first, second, third, and fourth surfaces are oriented such that the first surface and the second surface combine at a juncture line to form a first ridge extending along a center of the sole, the first surface and the third surface combine at a juncture line to form a second ridge extending away from the first ridge, the second surface and the fourth surface combine at a juncture line to form a third ridge extending away from a side of the first ridge opposite the second ridge, and the third surface and the fourth surface combine at a juncture line to form a fourth ridge extending away from the first ridge between the second and third ridges.

Still further aspects of the invention relate to a method in which a golf club head as described above is provided, having at least one channel as described above. The method may further include connecting a shaft to the head.

Other aspects of the invention relate to golf clubs that include a golf club head as described above and a shaft connected to the head, or a set of golf clubs including at least one golf club having a head as described above. For example, the golf club having a head as described above may be a fairway wood club or a hybrid club.

Other features and advantages of the invention will be apparent from the following description taken in conjunction with the attached drawings.

BRIEF DESCRIPTION OF THE DRAWINGS

To allow for a more full understanding of the present invention, it will now be described by way of example, with reference to the accompanying drawings in which.

DETAILED DESCRIPTION

Figure 1:
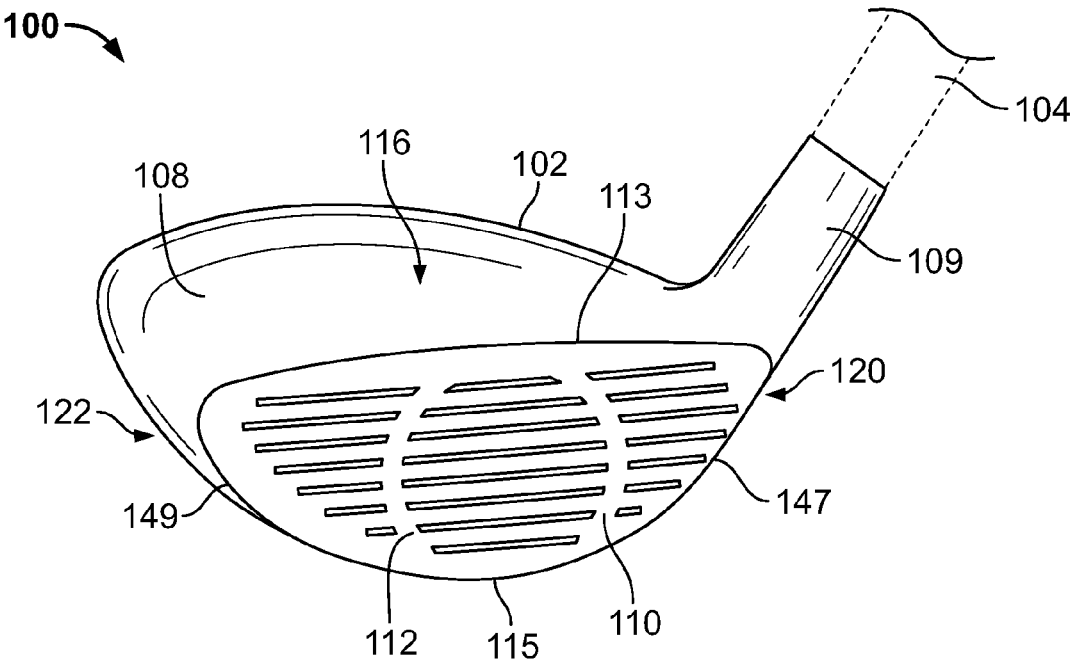
FIG. 1 is a front view of an illustrative embodiment of a head of a ball striking device according to the present invention.
Figure 2:
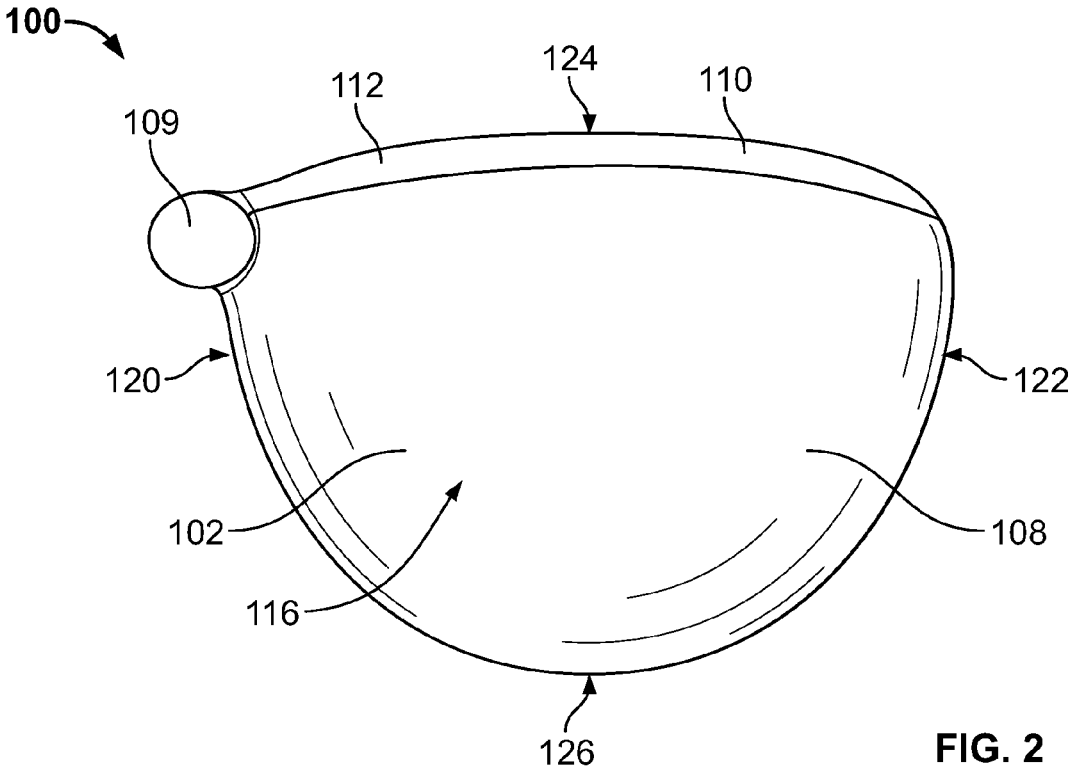
FIG. 2 is a top view of the head of FIG. 1.

In the following description of various example structures according to the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention. Also, while the terms "top," "bottom," "front," "back," "side," "rear," and the like may be used in this specification to describe various example features and elements of the invention, these terms are used herein as a matter of convenience, e.g., based on the example orientations shown in the figures or the orientation during typical use. Additionally, the term "plurality," as used herein, indicates any number greater than one, either disjunctively or conjunctively, as necessary, up to an infinite number. Nothing in this specification should be construed as requiring a specific three dimensional orientation of structures in order to fall within the scope of this invention. Also, the reader is advised that the attached drawings are not necessarily drawn to scale.

The following terms are used in this specification, and unless otherwise noted or clear from the context, these terms have the meanings provided below.

"Ball striking device" means any device constructed and designed to strike a ball or other similar objects (such as a hockey puck). In addition to generically encompassing "ball striking heads," which are described in more detail below, examples of "ball striking devices" include, but are not limited to: golf clubs, putters, croquet mallets, polo mallets, baseball or softball bats, cricket bats, tennis rackets, badminton rackets, field hockey sticks, ice hockey sticks, and the like.

"Ball striking head" means the portion of a "ball striking device" that includes and is located immediately adjacent (optionally surrounding) the portion of the ball striking device designed to contact the ball (or other object) in use. In some examples, such as many golf clubs and putters, the ball striking head may be a separate and independent entity from any shaft or handle member, and it may be attached to the shaft or handle in some manner.

The terms "shaft" and "handle" are used synonymously and interchangeably in this specification, and they include the portion of a ball striking device (if any) that the user holds during a swing of a ball striking device.

"Integral joining technique" means a technique for joining two pieces so that the two pieces effectively become a single, integral piece, including, but not limited to, irreversible joining techniques, such as adhesively joining, cementing, welding, brazing, soldering, or the like, where separation of the joined pieces cannot be accomplished without structural damage thereto.

"Virtual intersection point" means a point at which a first line, plane, edge, surface, etc. would intersect another line, plane, edge, surface, etc., if the first line, plane, edge, surface, etc. extended infinitely along a linear axis. A line, as referred to herein, includes a linear direction or axis, such as a direction or axis of extension or elongation.

"Generally parallel" means that a first line, plane, edge, surface, etc. is approximately (in this instance, within 5%) equidistant from another line, plane, edge, surface, etc., over at least 50% of the length of the first line, plane, edge, surface, etc.

In general, aspects of this invention relate to ball striking devices, such as golf club heads, golf clubs, putter heads, putters, and the like. Such ball striking devices, according to at least some examples of the invention, may include a ball striking head and a ball striking surface. In the case of a golf club, the ball striking surface is a substantially flat surface on one face of the ball striking head. Some more specific aspects of this invention relate to wood-type golf clubs and golf club heads, including fairway woods, hybrid clubs, and the like, as well as other wood-type golf clubs such as drivers, although aspects of this invention also may be practiced on iron-type clubs, putters, and other club types as well.

According to various aspects of this invention, the ball striking device may be formed of one or more of a variety of materials, such as metals (including metal alloys), ceramics, polymers, composites (including fiber-reinforced composites), and wood, and may be formed in one of a variety of configurations, without departing from the scope of the invention. In one illustrative embodiment, some or all components of the head, including the face and at least a portion of the body of the head, are made of metal. It is understood that the head may contain components made of several different materials, including carbon-fiber and other composites. Additionally, the components may be formed by various forming methods. For example, metal components, such as titanium and alloys thereof, aluminum and alloys thereof, steels (including stainless steels), and the like, may be formed by forging, molding, casting, stamping, machining, and/or other known techniques. In another example, composite components, such as carbon fiber-polymer composites, can be manufactured by a variety of composite processing techniques, such as prepreg processing, powder-based techniques, mold infiltration, and/or other known techniques.

The various figures in this application illustrate examples of ball striking devices according to this invention. When the same reference number appears in more than one drawing, that reference number is used consistently in this specification and the drawings refer to the same or similar parts throughout.

At least some examples of ball striking devices according to this invention relate to golf club head structures, including heads for wood-type golf clubs, such as fairway woods and hybrid clubs, as well as other types of wood-type clubs, long iron clubs (e.g., driving irons, zero irons through five irons, and hybrid type golf clubs), short iron clubs (e.g., six irons through pitching wedges, as well as sand wedges, lob wedges, gap wedges, and/or other wedges), and putters. Such devices may include a one-piece construction or a multiple-piece construction. Example structures of ball striking devices according to this invention will be described in detail below in conjunction with FIG. 1, which illustrates one illustrative embodiment of a ball striking device 100 in the form of a fairway wood golf club (e.g., a 3-wood, 5-wood, 7-wood, etc.) or other wood-type club, including a hybrid club, and FIG. 9, which illustrates another illustrative embodiment of a golf club 200 in the form of a fairway wood golf club, in accordance with at least some examples of this invention.

Figure 7:
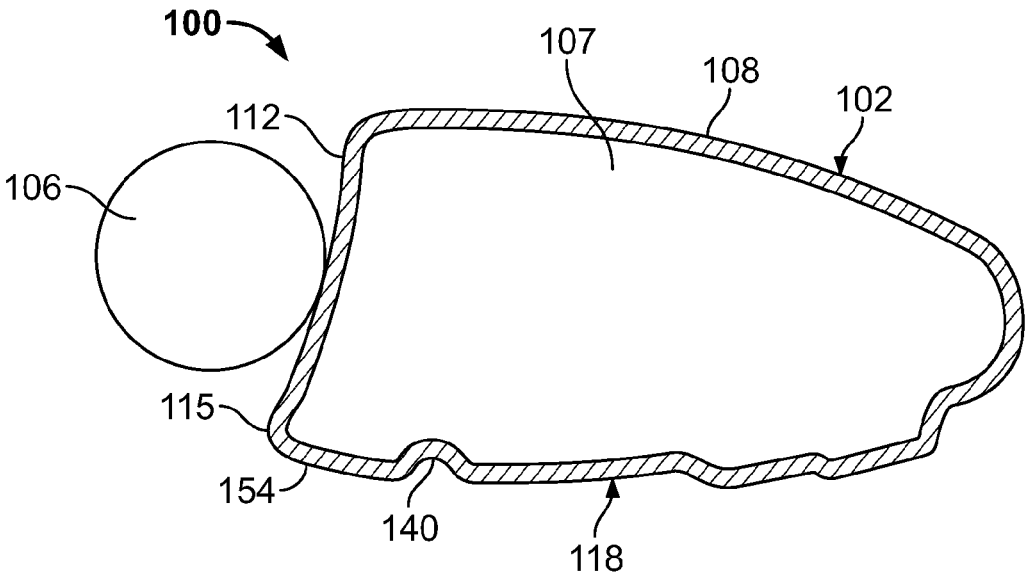
FIG. 7 is a cross-section view showing the head of FIG. 6, during impact of a ball on a ball striking face of the head.
Figure 8:
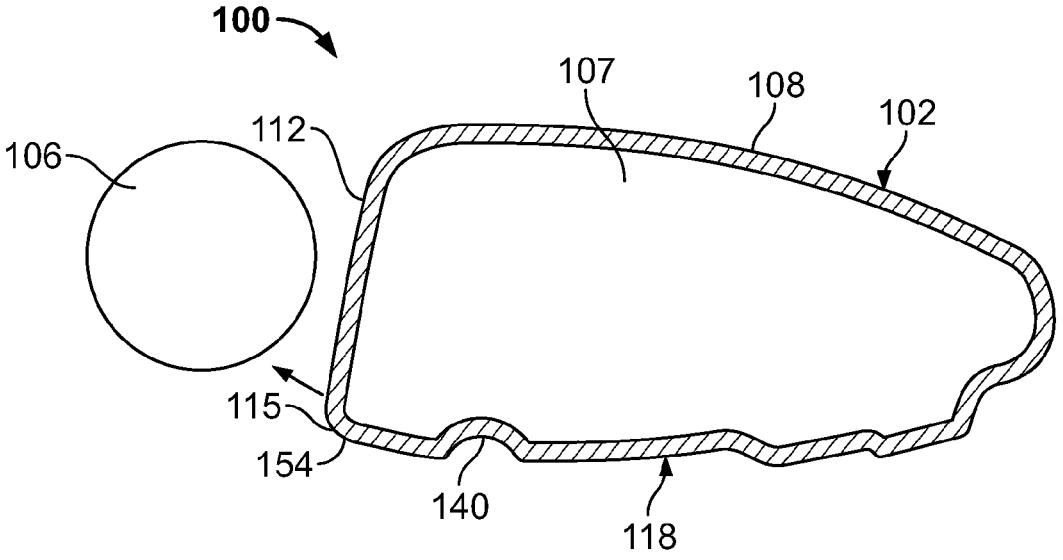
FIG. 8 is a cross-section view showing the head of FIG. 7, immediately after the impact.
Figure 9:
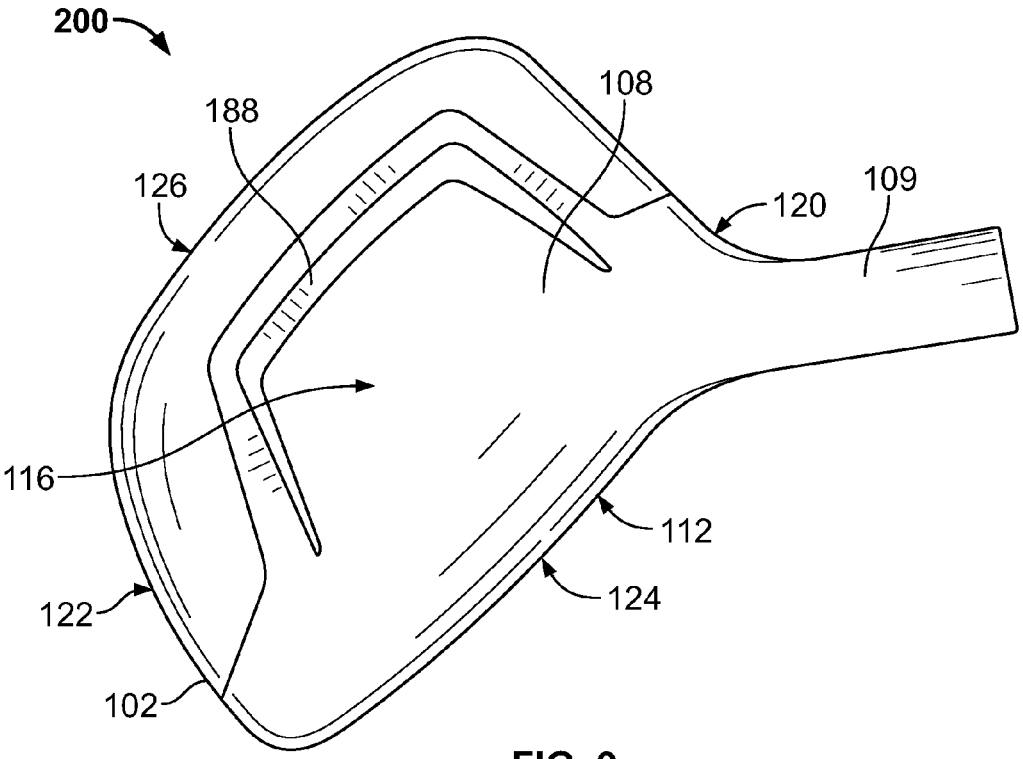
FIG. 9 is a top perspective view of a second illustrative embodiment of a head of a ball striking device according to the present invention.

The golf club 100 shown in FIGS. 1-8 and the golf club 200 shown in FIGS. 9-15 contain many common features, which are referenced by similar reference numerals in the description below. As shown in FIGS. 1 and 9, the golf club 100, 200 includes a ball striking head 102 configured to strike a ball in use and a shaft 104 connected to the ball striking head 102 and extending therefrom. The ball striking head 102 of the golf club 100 of FIG. 1 has a face 112 connected to a body 108, with a hosel 109 extending therefrom. Any desired hosel and/or head/shaft interconnection structure may be used without departing from this invention, including conventional hosel or other head/shaft interconnection structures as are known and used in the art, or an adjustable, releasable, and/or interchangeable hosel or other head/shaft interconnection structure such as those shown and described in U.S. Pat. No. 6,890,269 dated May 10, 2005, in the name of Bruce D. Burrows, U.S. Published Patent Application No. 2009/0011848, filed on Jul. 6, 2007, in the name of John Thomas Stites, et al., U.S. Published Patent Application No. 2009/0011849, filed on Jul. 6, 2007, in the name of John Thomas Stites, et al., U.S. Published Patent Application No. 2009/0011850, filed on Jul. 6, 2007, in the name of John Thomas Stites, et al., and U.S. Published Patent Application No. 2009/0062029, filed on Aug. 28, 2007, in the name of John Thomas Stites, et al., all of which are incorporated herein by reference in their entireties.

For reference, the head 102 generally has a top 116, a bottom or sole 118, a heel 120 proximate the hosel 109, a toe 122 distal from the hosel 109, a front 124, and a back or rear 126. The shape and design of the head 102 may be partially dictated by the intended use of the golf club 100. For example, it is understood that the sole 118 is configured to confront the playing surface in use. With clubs that are configured to hit a ball resting directly on the playing surface, such as a fairway wood, hybrid, iron, etc., the sole 118 may contact the playing surface in use, and features of the club may be designed accordingly. In the clubs 100, 200 shown in FIGS. 1 and 9, the head 102 has an enclosed volume, as the club 100 is a wood-type club designed for use as a fairway wood, intended to hit the ball intermediate distances, with or without the use of a tee, which may include hitting the ball resting directly on the playing surface. In other applications, such as for a different type of golf club, the head 102 may be designed to have different dimensions and configurations. For example, when configured as a fairway wood, as shown in FIGS. 1-8 and 9-15, the head 102 may have a volume of 120 cc to 230 cc, and if configured as a hybrid club, the head 102 may have a volume of 85 cc to 140 cc. If instead configured as a driver, the club head may have a volume of at least 400 cc, and in some structures, at least 450 cc, or even at least 460 cc. Other appropriate sizes for other club heads may be readily determined by those skilled in the art.

The body 108 of the head 102 can have various different shapes, including a rounded shape, as in the head 102 shown in FIGS. 1-8, a squared or rectangular shape, as in the head 102 shown in FIGS. 9-15, or other any of a variety of other shapes. It is understood that such shapes may be configured to distribute weight away from the face 112 and/or the geometric/volumetric center of the head 102, in order to create a lower center of gravity and/or a higher moment of inertia. Additionally, as seen in FIG. 9, the top 116 of the head 102 may contain a crown portion 188, which may be formed as a ridge or a shoulder. The crown portion 188 shown in FIG. 9 is shaped to assist the user with visually aligning and "framing" the ball before the swing.

In the illustrative embodiments illustrated in FIGS. 1 and 9, the head 102 has a hollow structure defining an inner cavity 107 (e.g., defined by the face 112 and the body 108). Thus, the head 102 has a plurality of inner surfaces defined therein. In one embodiment, the hollow inner cavity 107 may be filled with air. However, in other embodiments, the head 102 could be filled with another material, such as foam. In still further embodiments, the solid materials of the head may occupy a greater proportion of the volume, and the head may have a smaller cavity 107 or no inner cavity at all. It is understood that the inner cavity 107 may not be completely enclosed in some embodiments.

The face 112 is located at the front 124 of the head 102, and has a ball striking surface 110 located thereon and an inner surface 111 opposite the ball striking surface 110, as illustrated in FIGS. 6-8 and 13-15. The ball striking surface 110 is typically an outer surface of the face 112 configured to face a ball 106 in use, and is adapted to strike the ball 106 when the golf club 100 is set in motion, such as by swinging. As shown, the ball striking surface 110 is relatively flat, occupying at least a majority of the face 112. The face 112 has a plurality of peripheral edges, including a top edge 113, a bottom edge 115, and lateral edges (including heel edge 147 and toe edge 149). The edges of the face may be considered to be the boundaries of an area of the face 112 that is specifically designed to contact the ball 106 in use, and may be recognized as the boundaries of an area of the face 112 that is intentionally flattened and smoothed to be suited for ball contact. For reference purposes, the portion of the face 112 nearest the top face edge 113 and the heel 120 of the head 102 is referred to as the "high-heel area"; the portion of the face 112 nearest the top face edge 113 and toe 122 of the head 102 is referred to as the "high-toe area"; the portion of the face 112 nearest the bottom face edge 115 and heel 120 of the head 102 is referred to as the "low-heel area"; and the portion of the face 112 nearest the bottom face edge 115 and toe 122 of the head 102 is referred to as the "low-toe area". Conceptually, these areas may be recognized and referred to as quadrants of substantially equal size (and/or quadrants extending from a geometric center of the face 112), though not necessarily with symmetrical dimensions. The face 112 may include some curvature in the top to bottom and/or heel to toe directions (e.g., bulge and roll characteristics), as is known and is conventional in the art. In other embodiments, the surface 110 may occupy a different proportion of the face 112, or the body 108 may have multiple ball striking surfaces 110 thereon. In the illustrative embodiments shown in FIGS. 1 and 9, the ball striking surface 110 is inclined (i.e., at a loft angle), to give the ball 106 a desired lift and spin when struck. For example, when configured as a fairway wood, the head 102 may have a loft angle of between about 12° and about 32°, or in one embodiment, between about 15° and about 28°. As another example, when configured as a hybrid club, the head 102 may have a loft angle of between about 15° and about 30°. In other illustrative embodiments, the ball striking surface 110 may have a different incline or loft angle, to affect the trajectory of the ball 106. Additionally, the face 112 may have a variable thickness, and also may have one or more internal or external inserts in some embodiments.

It is understood that the face 112, the body 108, and/or the hosel 109 can be formed as a single piece or as separate pieces that are joined together. The face 112 may be formed as part of a face frame member 128 with the body 108 being partially or wholly formed by one or more separate pieces connected to the face frame member 128. The face frame member 128 may be formed as a cup face structure with a wall or walls 125 extending rearward from the edges of the face 112, as shown in the illustrative embodiments in FIGS. 6-8 and 13-15. Additionally, at least a portion of the body 108 may be formed by a backbody member 129 connected to the walls 125, which may be a single piece or multiple pieces, as also shown in the illustrative embodiments in FIGS. 6-8 and 13-15. In these embodiments, the walls 125 of the face frame member 128 combine with the backbody member 129 to form the body 108 of the head 102. These pieces may be connected by an integral joining technique, such as welding, cementing, or adhesively joining. Other known techniques for joining these parts can be used as well, including many mechanical joining techniques, including releasable mechanical engagement techniques. If desired, the hosel 109 may be integrally formed as part of the face frame member 128. Further, a gasket (not shown) may be included between the face frame member 128 and the backbody member 129.

The golf club 100, 200 may include a shaft 104 connected to or otherwise engaged with the ball striking head 102 as shown schematically in FIGS. 1 and 9. The shaft 104 is adapted to be gripped by a user to swing the golf club 100, 200 to strike the ball. The shaft 104 can be formed as a separate piece connected to the head 102, such as by connecting to the hosel 109, as shown in FIGS. 1 and 9. In other illustrative embodiments, at least a portion of the shaft 104 may be an integral piece with the head 102, and/or the head 102 may not contain a hosel 109 or may contain an internal hosel structure. Still further embodiments are contemplated without departing from the scope of the invention. The shaft 104 may be constructed from one or more of a variety of materials, including metals, ceramics, polymers, composites, or wood. In some illustrative embodiments, the shaft 104, or at least portions thereof, may be constructed of a metal, such as stainless steel or titanium, or a composite, such as a carbon/graphite fiber-polymer composite. However, it is contemplated that the shaft 104 may be constructed of different materials without departing from the scope of the invention, including conventional materials that are known and used in the art. A grip element (not shown) may be positioned on the shaft 104 to provide a golfer with a slip resistant surface with which to grasp golf club shaft 104. The grip element may be attached to the shaft 104 in any desired manner, including in conventional manners known and used in the art (e.g., via adhesives or cements, threads or other mechanical connectors, swedging/swaging, etc.).

In general, the ball striking heads 102 according to the present invention contain features on the body 108 that influence the impact of a ball on the face 112. Such features include one or more compression channels 140 positioned on the body 108 of the head 102 that allow at least a portion of the body 108 to flex, produce a reactive force, and/or change the behavior or motion of the face 112, during impact of a ball on the face 112. In one embodiment, at least a portion of the compression channel(s) 140 may extend parallel or generally parallel to one of the adjacent edges of the face 112. In the golf club 100 shown in FIGS. 1-8, and in the golf club 200 shown in FIGS. 9-15, the head 102 includes two compression channels 140 located on the sole 118 of the head 102. As described below, these channels 140 permit compression and flexing of the body 108 during impact on the face 112, and also produce a reactive force that can be transferred to the ball, as well as changing the motion and behavior of the face during impact. These two illustrative embodiments 100, 200 are described separately in greater detail below.

Figure 3:
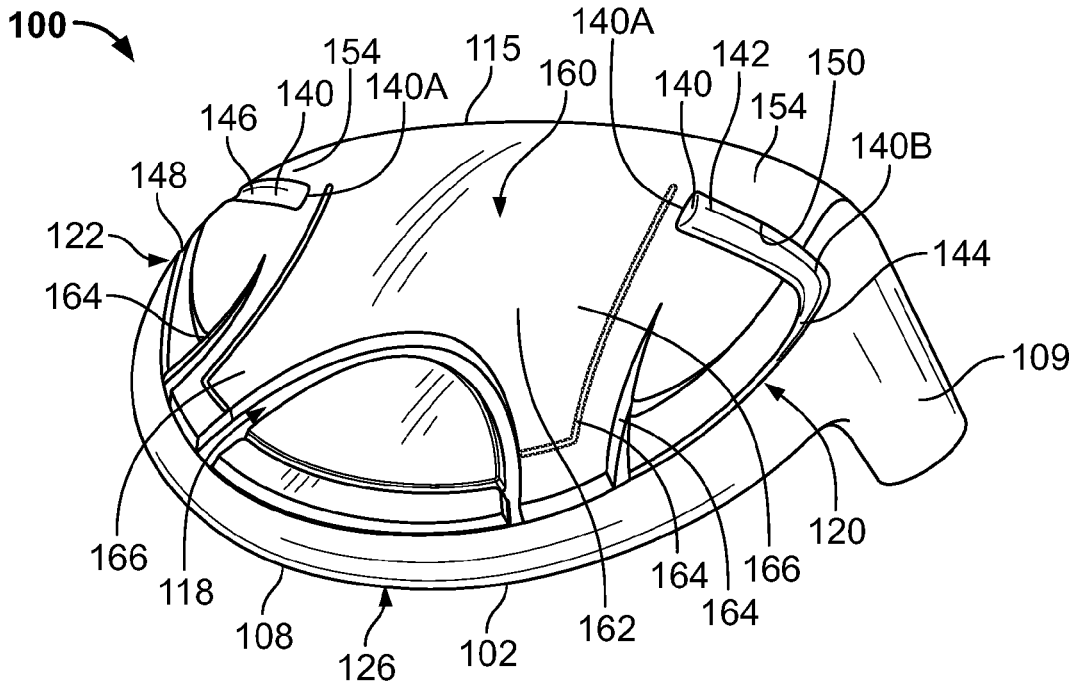
FIG. 3 is a bottom perspective view of the head of FIG. 1.
Figure 4:
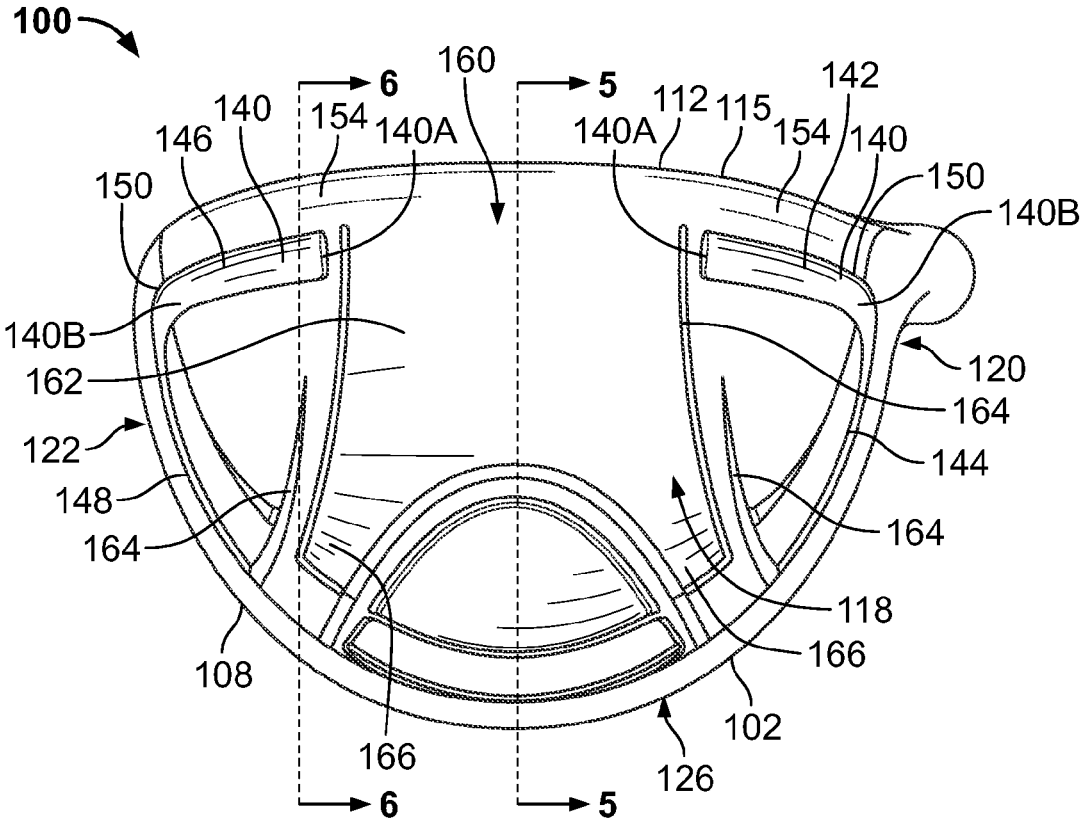
FIG. 4 is a bottom view of the head of FIG. 1.

The golf club 100 shown in FIGS. 1-8 includes two compression channels 140 positioned on the sole 118 of the head 102. As illustrated in FIGS. 3-4, a first elongated compression channel 140 is positioned toward the heel 120 of the head 102, and has a first portion 142 extending adjacent and to the bottom edge 115 of the face 112 and a second portion 144 that extends away from the first portion 142. The first portion 142 is elongated between a first or proximal end 140A and a second or distal end 140B along a direction that is parallel or generally parallel to one or more peripheral edges of the face 112, including at least the bottom edge 115. The second portion 144 curves away from the direction of the first portion 142 and extends away from the face 112 and toward the rear 126 of the head 102 along the side of the body 108 on the heel 120. A second elongated compression channel 140 is positioned toward the toe 122 of the head 102, and has a first portion 146 extending adjacent and parallel or generally parallel to the bottom edge 115 of the face 112 and a second portion 148 that extends away from the first portion 146. The first portion 146 is elongated between a first or proximal end 140A and a second or distal end 140B along a direction that is parallel or generally parallel to one or more peripheral edges of the face 112, including at least the bottom edge 115. The second portion 148 curves away from the direction of the first portion 146 and extends away from the face 112 and toward the rear 126 of the head 102 along the side of the body 108 on the toe 122. As seen in FIG. 4, the channels 140 are substantially symmetrically positioned on the head 102, and are substantially mirror images of each other, in this embodiment. In this embodiment, the proximal ends 140A of the channels 140 are positioned more proximate to the center of the sole 118, and the distal ends 140B are positioned more proximate the heel 120 and the toe 122, respectively.

Figure 6:
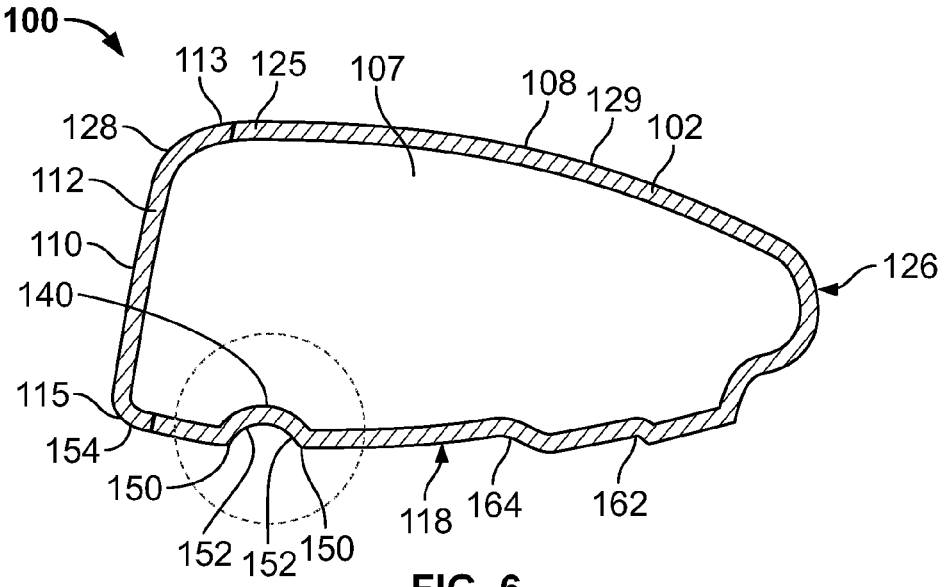
FIG. 6 is a cross-section view of the head of FIG. 1, taken along lines 6-6 of FIG. 4.
Figure 6A:
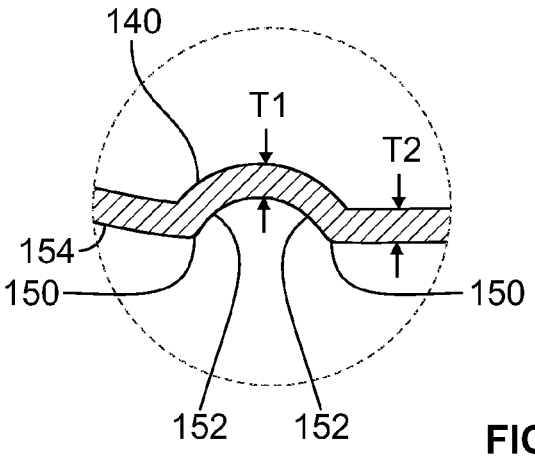
FIG. 6A is a magnified view of a portion of the head of FIG. 6.

Each of the channels 140 is recessed inwardly with respect to surfaces of the head 102 that are in contact with the boundary 150 of the channel 140, as shown in FIGS. 6 and 6A. The channels 140 in this embodiment have a trough-like shape, with sloping sides 152 that are smoothly curved. It is understood that the channels 140 may have a different shape or profile, such as the channels 140 of the device 200 in FIGS. 9-15, and the channels 140 may have a sharper and/or more polygonal shape in some embodiments. Additionally, in the embodiment shown in FIGS. 6 and 6A, the wall thickness (T1) is reduced at the channels 140, as compared to the thickness (T2) at other locations of the body, to provide for increased flexibility at the channels 140. In one embodiment, the wall thickness in the channels is from 0.8-1.5 mm.

As shown in FIGS. 4 and 6, the channels 140 are spaced from the bottom edge 115 of the face 112, with a flattened spacing portion 154 defined between the channel 140 and the bottom edge 115. The spacing portion 154 is oriented at an acute (i.e. <90°) angle to the ball striking surface 110 and extends rearward from the bottom edge 115 of the face 112 to the channel 140. Force from an impact on the face 112 can be transferred to the channels 140 through the spacing portion 154, as described below. In other embodiments, the spacing portion 154 may be oriented at a right angle or an obtuse angle to the ball striking surface 110, or the flattened spacing portion 154 may be smaller than the portion 154 shown in FIG. 6 or absent entirely.

As stated above, in the head 102 of FIGS. 1-8, the first portions 142, 146 of the channels 140 extend parallel to or generally parallel to the bottom edge 115 of the face 112. As seen in FIG. 4, the first portions 142, 146 of the channels 140 extend toward each other and are spaced approximately equal distances from the bottom edge 115 of the face, such that the channels 140 have a virtual intersection point if the channels 140 extended infinitely. However, in this embodiment, the channels 140 stop short of the center of the sole 118, such that a gap 160 is defined between the proximal ends 140A of the channels 140. The gap 160 is positioned to be substantially centered along a centerline of the sole 118 that extends from the front 124 to the rear 126 of the head 102. In one embodiment, each channel 140 ends approximately 9 mm from the centerline of the sole 118, such that the ends of the channels are spaced approximately 18 mm from each other.

Figure 5:
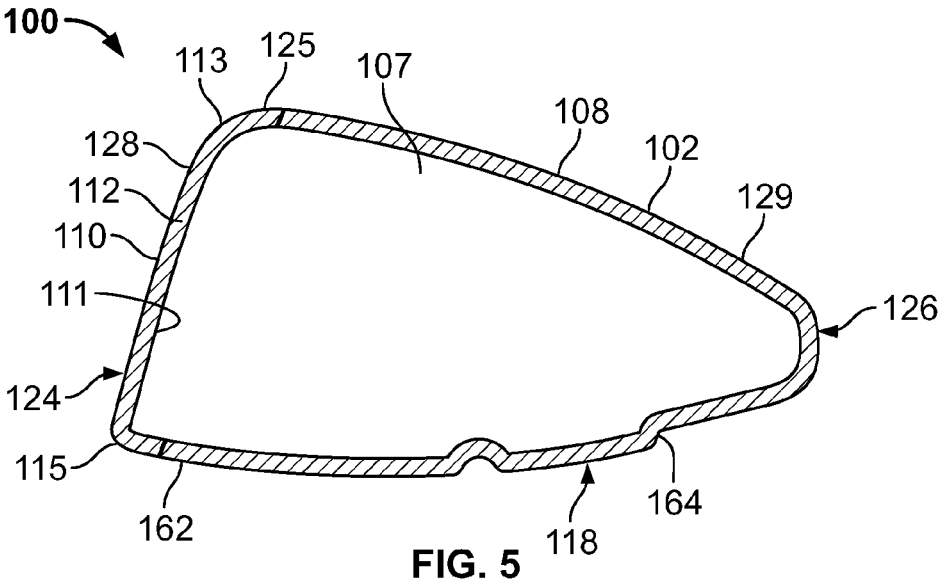
FIG. 5 is a cross-section view of the head of FIG. 1, taken along lines 5-5 of FIG. 4.

Additionally, the sole 118 has a keel 162 that is positioned at least partially within the gap 160 between the ends of the channels 140. In this embodiment, the keel 162 forms the lower extremity of the sole 118 and confronts the playing surface in use, and at least a portion of the keel 162 is raised or projecting with respect to adjacent portions of the sole 118. As shown in FIGS. 3-5, at least a portion of the keel 162 is defined by shoulders 164 that raise the keel 162 above the other portions of the sole 118 in contact with the shoulders 164. In this embodiment, the keel 162 slopes more gradually toward the rear 126 of the head 102 compared to adjacent portions of the sole 118, creating the shoulders 164. As also seen in FIG. 4, the width of the keel 162 increases as toward the rear 126 of the head 102, and the keel 162 splits into two legs 166 that separate further toward the rear 126 of the head 102.

Further, in this embodiment, at least a portion of the sole 118 within the gap 160 has a substantially smooth surface. As shown in FIGS. 3-5, the keel 162 forms a substantially smooth surface extending from the bottom edge 115 of the face 112 toward the rear 126 of the head 102. It is understood that in this embodiment, the keel 162 has a substantially smooth curvilinear shape, as well as a substantially smooth surface texture, and that the term, "substantially smooth surface" can refer to either or both of the substantially smooth contour and surface texture of the surface. It is also understood that the substantially smooth surface may have some discontinuity, such as a logo or other marking, and still be considered substantially smooth. In this embodiment, the smooth surface of the keel 162 is polished to further increase the smoothness of the surface texture.

The smooth contour and texture of the substantially smooth surface of the keel 162 provide for decreased friction and/or other forces on the sole 118 if the sole 118 contacts the playing surface in use. Additionally, because the channels 140 do not extend across the center of the sole 118 or across the lowest point on the sole 118, any interaction between the channels 140 and the playing surface in use, which may exert increased drag or other forces on the sole 118, can be minimized or eliminated. Accordingly, forces on the sole 118 which may slow the speed of the head 102, alter the orientation or position of the head 102, and/or otherwise affect the swinging motion of the head 102 can be reduced appreciably. This configuration provides advantages when incorporated into fairway woods, hybrid clubs, or other such golf clubs which may be used to hit a ball resting directly on a playing surface, resulting in possible contact between the sole 118 and the playing surface in use. Nevertheless, it is understood that the features described herein can be advantageous when incorporated into a different type of golf club, including a driver or non-wood-type clubs such as irons and putters, as well as other ball striking devices.

Figure 10:
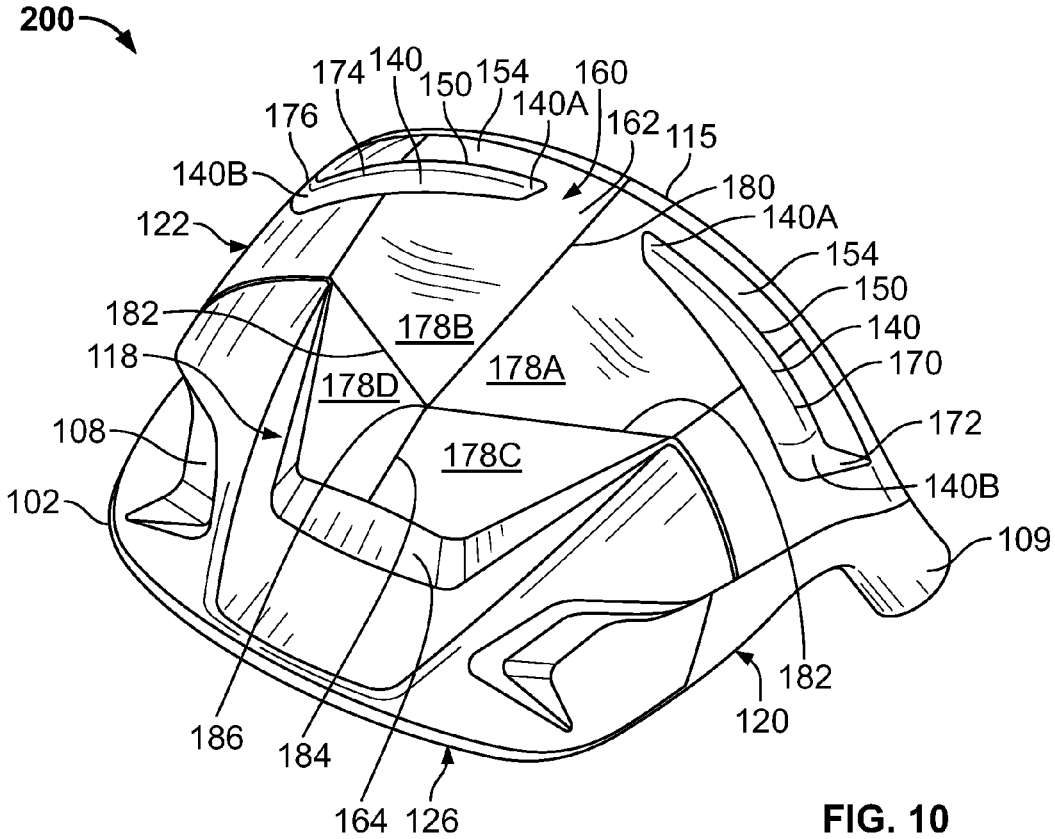
FIG. 10 is a bottom perspective view of the head of FIG. 9.
Figure 11:
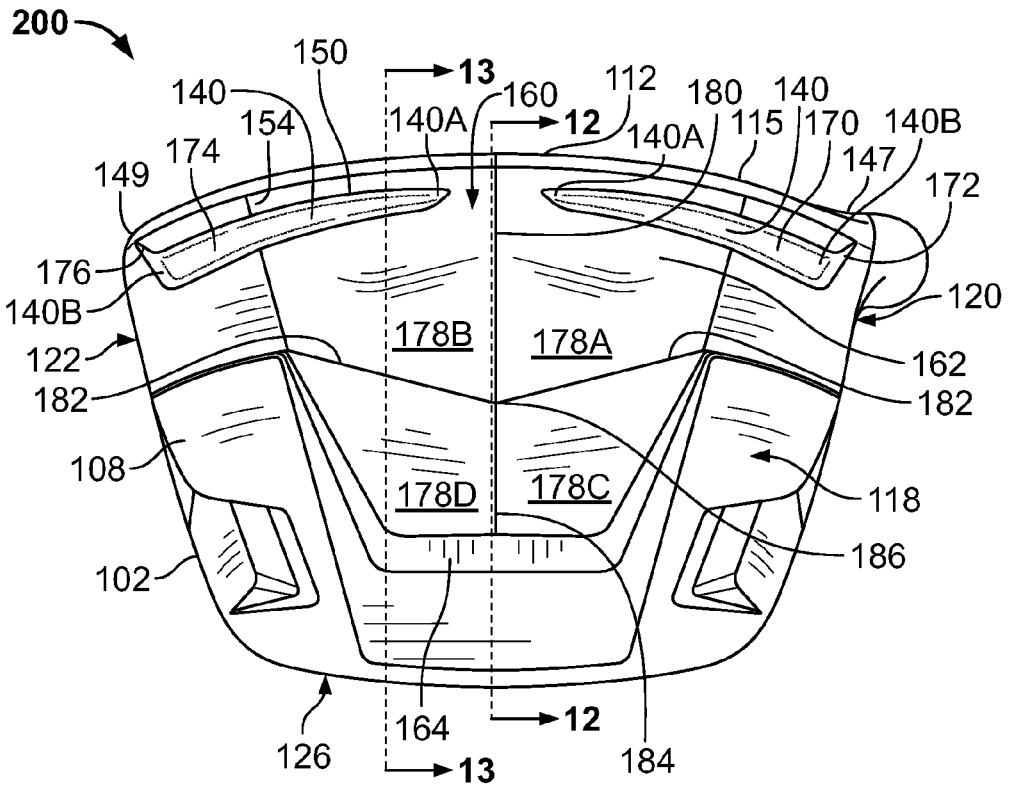
FIG. 11 is a bottom view of the head of FIG. 9.

The golf club 200 shown in FIGS. 9-15 includes many features in common with the golf club 100 shown in FIGS. 1-8 and described above, and common reference numerals are used to describe such common features. The head 102 of the golf club 200 in FIGS. 9-15 includes two compression channels 140 positioned on the sole 118. As illustrated in FIGS. 10-11, a first elongated compression channel 140 is positioned toward the heel 120 of the head 102, and has a first portion 170 extending adjacent and parallel or generally parallel to the bottom edge 115 of the face 112 and a second portion 172 that extends away from the first portion 170. The first portion 170 is elongated between a first or proximal end 140A and a second or distal end 140B along a direction that is parallel or generally parallel to one or more peripheral edges of the face 112, including at least the bottom edge 115. The second portion 172 angles away from the direction of the first portion 170 and extends toward the face 112 and tapers to a point at or near the bottom edge 115 of the face 112. A second elongated compression channel 140 is positioned toward the toe 122 of the head 102, and has a first portion 174 extending adjacent and parallel or generally parallel to the bottom edge 115 of the face 112 and a second portion 176 that extends away from the first portion 174. The first portion 174 is elongated between a first or proximal end 140A and a second or distal end 140B along a direction that is parallel or generally parallel to one or more peripheral edges of the face 112, including at least the bottom edge 115. The second portion 176 angles away from the direction of the first portion 174 and extends toward the face 112, and tapers to a point at or near the bottom edge 115 of the face 112. As seen in FIG. 11, the channels 140 are substantially symmetrically positioned on the head 102, and are substantially mirror images of each other, in this embodiment. In this embodiment, the proximal ends 140A of the channels 140 are positioned more proximate to the center of the sole 118, and the distal ends 140B are positioned more proximate the heel 120 and the toe 122, respectively.

Figure 13:
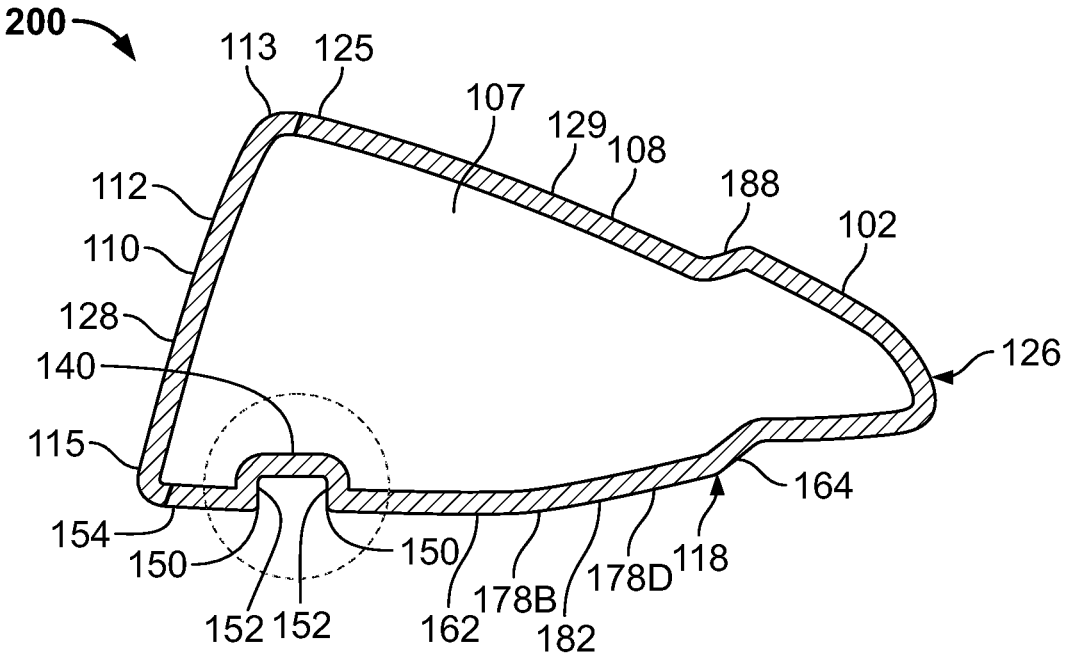
FIG. 13 is a cross-section view of the head of FIG. 1, taken along lines 13-13 of FIG. 11.
Figure 13A:
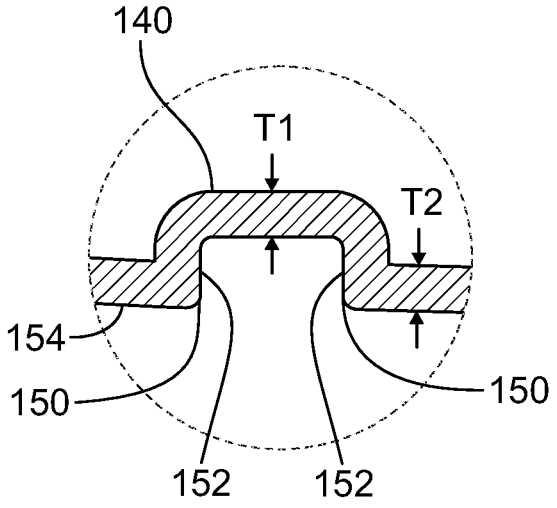
FIG. 13A is a magnified view of a portion of the head of FIG. 13.

Each of the channels 140 is recessed inwardly with respect to surfaces of the head 102 that are in contact with the boundary 150 of the channel 140, as shown in FIGS. 13 and 13A. The channels 140 in this embodiment have a slotted and substantially square or rectangular cross-sectional shape, with sides 152 that angle sharply inward and a substantially flat bottom. As described above, it is understood that the channels 140 may have a different shape or profile in other embodiments. Additionally, in the embodiment shown in FIGS. 13 and 13A, the wall thickness (T1) is reduced at the channels 140, as compared to the thickness (T2) at other locations of the body, to provide for increased flexibility at the channels 140. In one embodiment, the wall thickness in the channels is from 0.8-1.5 mm. Further, each of the channels 140 has a width that is defined between the front and rear edges of the boundary 150, and the width of each channel is smaller at the proximal end 140A and larger at the distal end 140B. In the embodiment illustrated in FIGS. 10-11, the width of each channel 140 increases continuously from the proximal end 140A toward the distal end 140B, and the width of each channel 140 increases in a tapering configuration from the proximal end 140A toward the distal end 140B.

As shown in FIGS. 11 and 13, the channels 140 are spaced from the bottom edge 115 of the face 112, with a flattened spacing portion 154 defined between the channel 140 and the bottom edge 115. The spacing portion 154 is oriented at an acute (i.e. <90°) angle to the ball striking surface 110 and extends rearward from the bottom edge 115 of the face 112 to the channel 140. The spacing portion 154 forms a smooth surface between the front edge of the boundary 150 and the peripheral edge (e.g., the bottom edge 115) of the face, as shown in FIGS. 10-11. Force from an impact on the face 112 can be transferred to the channels 140 through the spacing portion 154, as described below. In other embodiments, the spacing portion 154 may be oriented at a right angle or an obtuse angle to the ball striking surface 110, or the flattened spacing portion 154 may be smaller than the portion 154 shown in FIG. 13 or absent entirely.

As stated above, in the head 102 of FIGS. 9-15, the first portions 170, 174 of the channels 140 extend parallel to or generally parallel to the bottom edge 115 of the face 112. As seen in FIG. 11, the first portions 170, 174 of the channels 140 extend toward each other, and are spaced approximately equal distances from the bottom edge 115 of the face, such that the channels 140 have a virtual intersection point if the channels 140 extended infinitely. However, in this embodiment, the channels 140 stop short of the center of the sole 118, such that a gap 160 is defined between the proximal ends 140A of the channels 140. The gap 160 is positioned to be substantially centered along a centerline of the sole 118 that extends from the front 124 to the rear 126 of the head 102. Additionally, the sole 118 has a keel 162 that is positioned at least partially within the gap 160 between the ends of the channels 140. In this embodiment, the keel 162 forms the lower extremity of the sole 118 and confronts the playing surface in use, and at least a portion of the keel 162 is raised with respect to adjacent portions of the sole 118. As shown in FIGS. 3-5, at least a portion of the keel 162 is defined by shoulders 164 that raise the keel 162 above the other portions of the sole 118 in contact with the shoulders 164. In this embodiment, the keel 162 slopes more gradually toward the rear 126 of the head 102 compared to adjacent portions of the sole 118, creating the shoulders 164. As also seen in FIG. 4, the width of the keel 162 decreases toward the rear 126 of the head 102.

Figure 12:
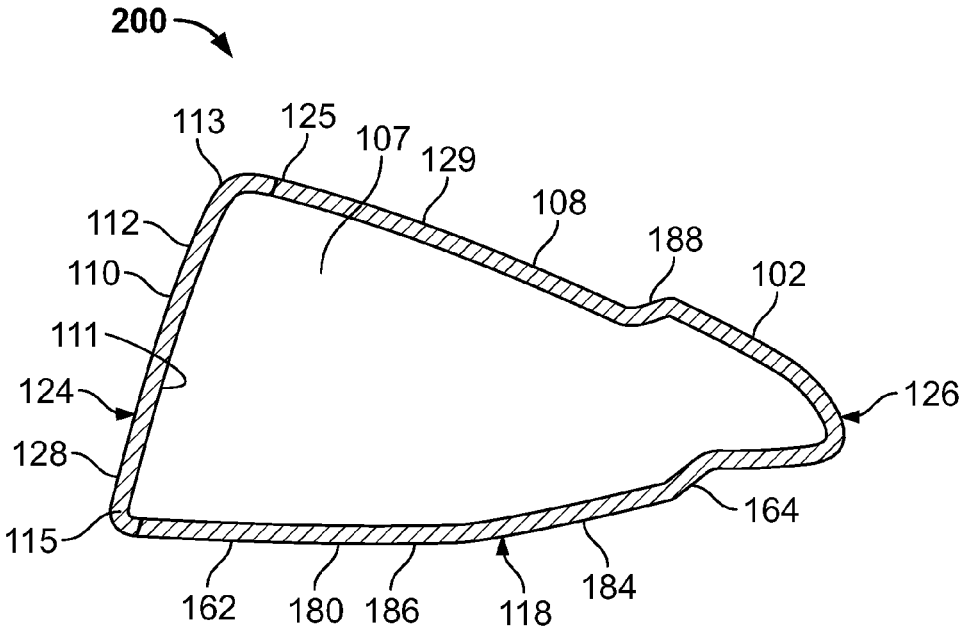
FIG. 12 is a cross-section view of the head of FIG. 9, taken along lines 12-12 of FIG. 11.

Further, in this embodiment, at least a portion of the sole 118 within the gap 160 is a substantially smooth surface. As shown in FIGS. 10-12, the keel 162 is formed of four substantially smooth, substantially planar surfaces 178A-D that are oriented at slight, oblique angles to each other. In the embodiment shown, all four of the planar surfaces 178A-D have different orthogonal orientations. Two front surfaces 178A-B extend rearward from the bottom edge 115 of the face 112 and converge along a juncture line to form a center ridge 180 approximately at the centerline of the sole 118. The center ridge 180 is adapted to form the lowest point on the head 102 when the golf club 200 is in use. The rear surfaces 178C-D are oriented at slight angles to each other and also at slight angles to the front surfaces 178A-B. As a result, the rear surfaces 178C-D converge with the front surfaces 178A-B along juncture lines to form ridges 182 extending from opposite sides of the center ridge 180 toward the heel 120 and the toe 122 of the head. The rear surfaces 178C-D also converge with each other along another juncture line to form a second center ridge 184 that is aligned with the center ridge 180 and extends from the first ridge 180 in a direction between the ridges 182. All of the ridges 180, 182, 184 extend outwardly along the juncture lines from a convergence point 186 where all four smooth planar surfaces 178A-D converge. Thus, the keel 162 forms a substantially smooth surface extending from the bottom edge 115 of the face 112 toward the rear 126 of the head 102. As such, the keel 162 of the head 102 in FIGS. 9-15 has a substantially smooth surface, which, as described above, may include one or both of a substantially smooth surface texture and a substantially smooth planar contour.

The specific orthogonal orientations of the planar surfaces 178A-D and the juncture lines and/or ridges 180, 182, 184 located between the planar surfaces 178A-D may vary in different embodiments. Generally, in the embodiment illustrated in FIGS. 9-15, the planar surfaces 178A-D form four angles at the convergence point 186. The front surfaces 178A-B form acute points at the convergence point, and the angles between the center ridge 180 and the ridges 182 are formed as acute angles that are substantially identical to each other. The rear surfaces 178C-D form obtuse points at the convergence point 186, and the angles between the second center ridge 184 and the ridges 182 are formed as obtuse angles that are substantially identical to each other.

Additionally, the center ridge 180 is able to glide along the playing surface, and the planar surfaces 178A-D are able to push foreign objects (e.g. grass, debris, etc.) to the sides during the swing, to reduce potential interference. Furthermore, because the channels 140 do not extend across the center of the sole 118 or across the lowest point on the sole 118, any interaction between the channels 140 and the playing surface in use, which may exert increased drag or other forces on the sole 118, can be minimized or eliminated. Accordingly, forces on the sole 118 which may slow the speed of the head 102, alter the orientation or position of the head 102, and/or otherwise affect the swinging motion of the head 102 can be reduced appreciably. Similarly to the configuration described above and shown in FIGS. 1-8, the configuration of the golf club 200 in FIGS. 9-15 provides advantages when incorporated into fairway woods, hybrid clubs, or other such golf clubs which may be used to hit a ball sitting directly on a playing surface, resulting in possible contact between the sole 118 and the playing surface in use. Nevertheless, it is understood that the features described herein can be advantageous when incorporated into a different type of golf club, including a driver or non-wood-type clubs such as irons and putters, as well as other ball striking devices.

It is understood that the head 102 may have one or more channels 140 in a different configuration in other embodiments. In one embodiment, the head 102 may include a channel or channels in a similar configuration to the channels 140 of FIGS. 1-8 and/or 9-15, but with the channel(s) extending across the center of the sole 118 adjacent the bottom face edge 115, with no defined gap. Such a configuration may be desirable for a driver-type club, which is intended to hit the ball from a tee and is not intended to be used to hit a ball at rest on the playing surface. In another embodiment, the head 102 may have one or more channels on the top 116, the heel 120, and/or the toe 122, either instead of or in combination with one or more channels on the sole 118. In a further embodiment, the head 102 may have one or more channels on an interior surface of the body 108, rather than on the exterior. In yet another embodiment, the head 102 may have two or more channels 140 spaced different distances from the face 112, and these channels 140 may "overlap" each other, creating a bellows-like effect in compression. Still other embodiments are contemplated.

Figure 14:
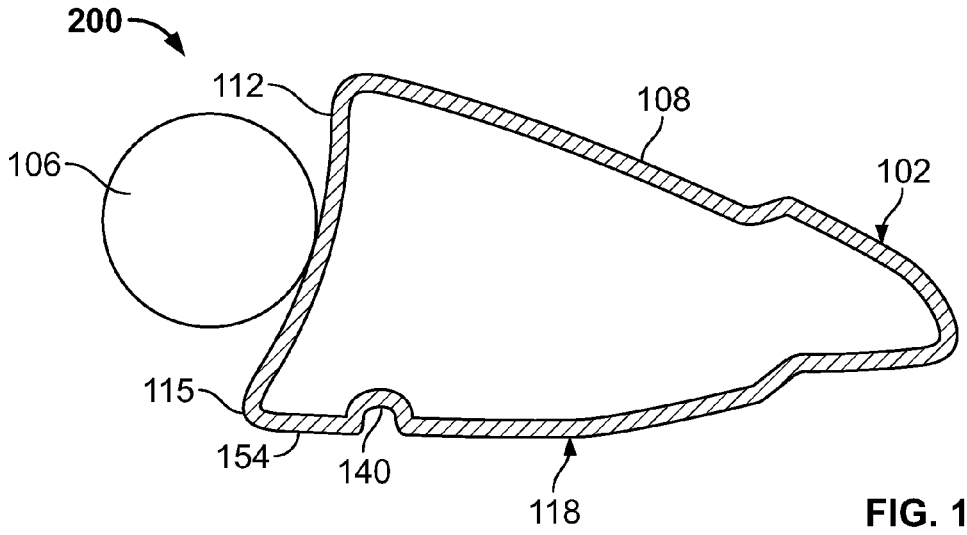
FIG. 14 is a cross-section view showing the head of FIG. 13, during impact of a ball on a ball striking face of the head.
Figure 15:
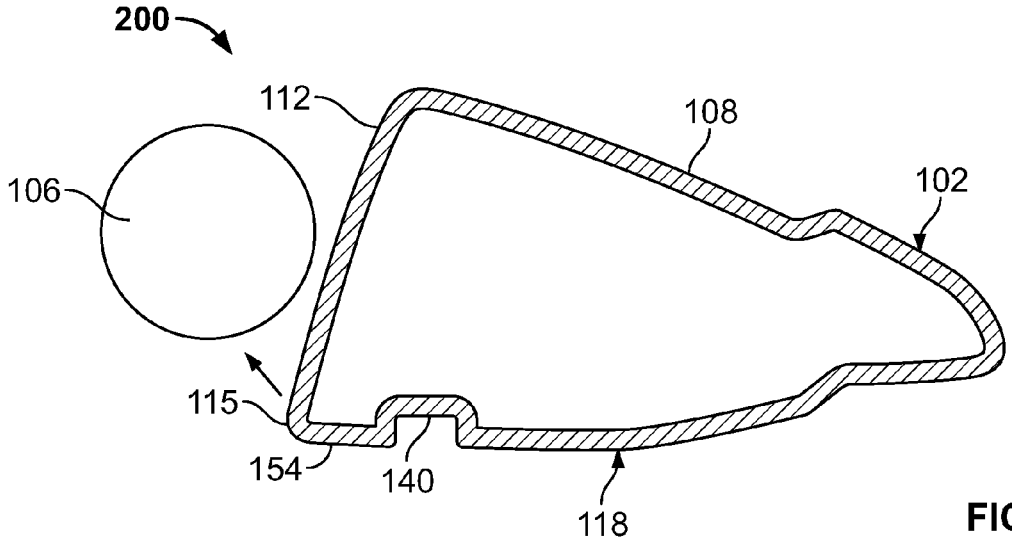
FIG. 15 is a cross-section view showing the head of FIG. 14, immediately after the impact.
Figure 16:
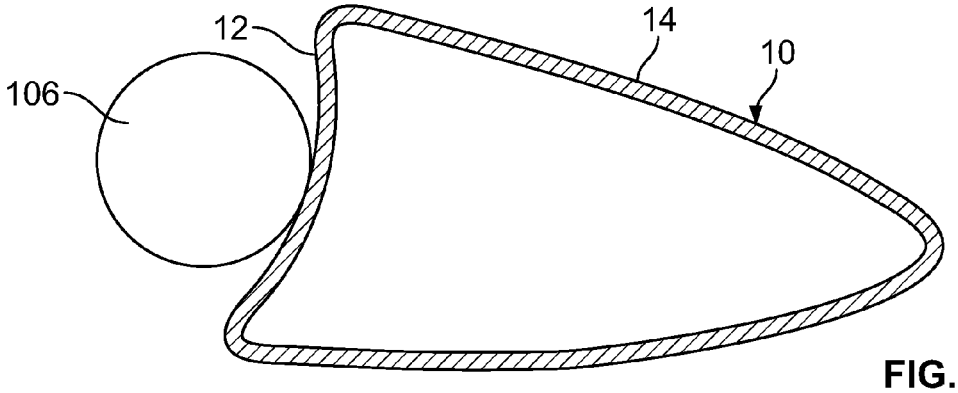
FIG. 16 (Prior Art)
FIG. 16 is a cross-section view of a head of an existing ball striking device, during impact of a ball on a ball striking face of the head.

The compression channels 140 on the golf clubs 100, 200 shown in FIGS. 1-8 and 9-15 influence the impact of a ball on the face 112 of the head 102. In one embodiment, the channels 140 can influence the impact by flexing or compressing in response to the impact on the face 112 and/or exerting a reaction force on the face 112 during impact. FIGS. 7-8 illustrate an example of the head 102 of the golf club 100 of FIGS. 1-8 during and after an impact with a ball 106, and FIGS. 14 and 15 illustrate an example of the head 102 of the golf club 200 of FIGS. 9-15 during and after an impact with a similar ball 106. For comparison, FIG. 16 illustrates a typical example of an existing ball striking head 10, having a face 12 and a body 14, during impact with a similar ball 106. In the embodiment shown in FIGS. 7-8 and 14-15, the face 112 and the channels 140 combine to absorb the force of the impact with the ball 106, in contrast to many existing heads, such as the head 10 of FIG. 16, where most of the impact is absorbed by the face 12. As such, in one embodiment, the head 102 may have a face 112 that is thinner than the faces of many existing club heads, as the face 112 does not absorb as much of the impact. As seen in FIGS. 7 and 14, when the ball 106 impacts the face 112, the face 112 flexes inwardly. Additionally, some of the impact force is transferred through the spacing portion 154 to the channels 140, causing the sole 118 to flex at the channels 140, as also seen in FIGS. 7 and 14. This flexing creates a more gradual impact with the ball 106 as compared to a traditional head 10 (FIG. 16), which results in a smaller degree of deformation of the ball 106 as compared to the traditional head 10. This smaller degree of deformation can result in greater impact efficiency and greater energy and velocity transfer to the ball 106 during impact. The more gradual impact created by the flexing also creates a longer impact time, which can result in greater energy and velocity transfer to the ball 106 during impact. Further, as the compressed channel 140 expands to return to its initial shape (i.e. FIGS. 8 and 15), a responsive or reactive force is exerted on the face 112, creating an increased "trampoline"

effect, which can result in greater energy and velocity transfer to the ball 106 during impact. Also, because the channels 140 extend toward the heel 120 and toe 122, and overlap the heel and toe edges 147, 149 of the face 112, the head 102 can achieve increased energy and velocity transfer to the ball 106 for impacts that are away from the center or traditional "sweet spot" of the face 112. It is understood that channels 140 may be additionally or alternately incorporated into the top 116 and/or sides 120, 122 of the body 108 in order to produce similar effects for energy and velocity transfer.

Heads 102 incorporating the compression channels 140 disclosed herein may be used as a ball striking device or a part thereof. For example, a golf club 100, 200 as shown in FIGS. 1-8 and 9-15 may be manufactured by attaching a shaft or handle 104 to a head that is provided, such as the head 102 as described above. "Providing" the head, as used herein, refers broadly to making an article available or accessible for future actions to be performed on the article, and does not connote that the party providing the article has manufactured, produced, or supplied the article or that the party providing the article has ownership or control of the article. In other embodiments, different types of ball striking devices can be manufactured according to the principles described herein. Manufacturing the heads 102 shown in FIGS. 1-8 and 9-15 may include attachment of a single- or multi-piece backbody member 129 to a face frame member 128, as described above. Additionally, the head 102, golf club 100, 200, or other ball striking device may be fitted or customized for a person, such as by attaching a shaft 104 thereto having a particular length, flexibility, etc., or by adjusting or interchanging an already attached shaft 104 as described above. In one embodiment, a set of golf clubs can be manufactured, where at least one of the clubs has a head with one or more compression channels, as described above.

The ball striking devices and heads therefor as described herein provide many benefits and advantages over existing products. For example, the combined impact absorption of the face 112 and the channels 140 caused by the flexing of the channels 140 creates a more gradual impact with the ball 106, which can result in a smaller degree of deformation of the ball 106, which in turn can result in greater impact efficiency and greater energy and velocity transfer to the ball 106 during impact. As another example, the more gradual impact created by the flexing can create a longer impact time, which can also result in greater energy and velocity transfer to the ball 106 during impact. As a further example, the responsive or reactive force exerted on the face 112 as the compressed channel expands to return to its initial shape is imparted to the ball, which can result in greater energy and velocity transfer to the ball 106 during impact. Still further, because the channels 140 extend toward the heel and toe edges 147, 149 of the face 112, the head 102 can achieve increased energy and velocity transfer to the ball 106 for impacts that are away from the center or traditional "sweet spot" of the face 112. As yet another example, the substantially smooth keel 162 and the gap 160 between the channels can decrease drag and other forces on the sole 118 during contact with the playing surface, which can increase distance and accuracy. The arrangement of the keel surfaces (e.g. 178A-D) may further assist in reducing drag on the sole 118. Further benefits and advantages are recognized by those skilled in the art.

While the invention has been described with respect to specific examples including presently preferred modes of carrying out the invention, those skilled in the art will appreciate that there are numerous variations and permutations of the above described systems and methods. Thus, the spirit and scope of the invention should be construed broadly as set forth in the appended claims.

What is claimed is:

1. A golf club head comprising:

a face having an outer surface configured for striking a ball;

a body connected to the face and extending rearward from the face, the body including a heel, a toe, a top side, and a sole configured to confront a playing surface in use, wherein the body and the face combine to define an enclosed interior cavity;

a first inwardly recessed channel at least partially located on the sole of the body and being configured to influence an impact of a ball on the face, the first channel having a proximal end located more proximate a center of the sole and a distal end located more proximate the heel, and wherein the first channel has front and rear boundary edges and front and rear side walls extending continuously inwardly from the front and rear boundary edges to a trough, wherein the front boundary edge junctures with a spacing portion extending from the front boundary edge to a peripheral edge of the face to form a smooth surface between the front boundary edge and the peripheral edge of the face, and the rear boundary edge junctures with the sole; and a second inwardly recessed channel at least partially located on the sole of the body and being configured to influence the impact of the ball on the face, the second channel having a proximal end located more proximate the center of the sole and a distal end located more proximate the toe, and wherein the second channel has front and rear boundary edges and front and rear side walls extending continuously inwardly from the front and rear boundary edges to a trough, wherein the front boundary edge junctures with the spacing portion to form a smooth surface between the front boundary edge and the peripheral edge of the face, and the rear boundary edge junctures with the sole, wherein the proximal end of the first channel is spaced from the proximal end of the second channel, wherein the first and second channels are more proximate to the face than to a rear of the body, wherein the first and second channels each have a width defined between the front and rear boundary edges, and the width of each of the first and second channels is smaller at the proximal end and larger at the distal end, and wherein the first and second channels are recessed with respect to portions of the sole located along the front boundary edge and the rear boundary edge, and proximate a center of the sole.

2. The golf club head of claim 1, wherein the width of each of the first and second channels increases continuously from the proximal end toward the distal end.

3. The golf club head of claim 1, wherein a gap is defined between the proximal ends of the first and second channels, wherein a geometric centerline of the sole extends through the gap, and wherein the first and second channels are recessed with respect to portions of the sole located within the gap.

4. The golf club head of claim 3, a wall thickness of the first channel and a wall thickness of the second channel are smaller than a wall thickness of an adjacent portion of the sole located within the gap.

5. The golf club head of claim 1, wherein the front boundary edges of the first and second channels extend generally parallel to the peripheral edge of the face.

6. The golf club head of claim 1, wherein the front and rear side walls and the trough of each of the first and second channels are oriented to form angles with each other.

7. A golf club head comprising:

a face having an outer surface configured for striking a ball;

a body connected to the face and extending rearward from the face, the body including a heel, a toe, a top side, and a sole configured to confront a playing surface in use, wherein the body and the face combine to define an enclosed interior cavity;

a first inwardly recessed channel at least partially located on the sole of the body and being configured to influence an impact of a ball on the face, the first channel having a proximal end located more proximate a center of the sole and a distal end located more proximate the heel, wherein the first channel has front and rear boundary edges, a trough, and front and rear side walls extending continuously inwardly from the front and rear boundary edges to the trough, wherein the front boundary edge junctures with a spacing portion extending from the front boundary edge to a peripheral edge of the face to form a smooth surface between the front boundary edge and the peripheral edge of the face, and the rear boundary edge junctures with the sole; and a second inwardly recessed channel at least partially located on the sole of the body and being configured to influence the impact of the ball on the face, the second channel having a proximal end located more proximate a center of the sole and a distal end located more proximate the toe, wherein the second channel has front and rear boundary edges, a trough, and front and rear side walls extending continuously inwardly from the front and rear boundary edges to the trough, wherein the front boundary edge junctures with a spacing portion extending from the front boundary edge to a peripheral edge of the face to form a smooth surface between the front boundary edge and the peripheral edge of the face, and the rear boundary edge junctures with the sole, wherein the first and second channels are more proximate to the face than to a rear of the body, wherein the first and second channels each have a width defined between the front and rear boundary edges, and the widths of the first and second channels are smaller at the proximal end and larger at the distal end, and wherein the first and second channels are recessed with respect to portions of the sole located along the front boundary edge and the rear boundary edge, and proximate a center of the sole.

8. The golf club head of claim 7, wherein a wall thickness of the first channel and a wall thickness of the second channel are different from a wall thickness of an adjacent portion of the sole.

9. The golf club head of claim 8, wherein the wall thickness of the first channel and the wall thickness of the second channel are smaller than the wall thickness of the adjacent portion of the sole.

10. The golf club head of claim 7, wherein the front and rear side walls and the trough of the first channel are oriented to form angles with each other, and the front and rear side walls and the trough of the second channel are oriented to form angles with each other.

11. The golf club head of claim 7, wherein the front boundary edges of the first and second channels extend generally parallel to the peripheral edge of the face.

12. The golf club head of claim 7, wherein the width of each of the first channel and the second channel increases in a tapering configuration from the proximal end to the distal end.

13. The golf club head of claim 7, wherein a gap is defined between the proximal ends of the first and second channels, wherein a geometric centerline of the sole extends through the gap, and wherein the first and second channels are recessed with respect to portions of the sole located within the gap.

14. The golf club head of claim 13, wherein the sole has a smooth surface within the gap that forms a lowermost surface of the golf club head in use.

15. A golf club head comprising:

a face having an outer surface configured for striking a ball;

a body connected to the face and extending rearward from the face, the body including a heel, a toe, a top side, and a sole configured to confront a playing surface in use;

a first inwardly recessed channel at least partially located on the sole of the body and being configured to influence an impact of a ball on the face, the first channel having a proximal end located more proximate a center of the sole and a distal end located more proximate the toe, wherein the first channel has front and rear boundary edges, a trough, and front and rear side walls extending continuously inwardly from the front and rear boundary edges to the trough, wherein the front boundary edge junctures with a spacing portion extending from the front boundary edge to a peripheral edge of the face to form a smooth surface between the front boundary edge and the peripheral edge of the face, and the rear boundary edge junctures with the sole; and a second inwardly recessed channel at least partially located on the sole of the body and being configured to influence the impact of the ball on the face, the second channel having a proximal end located more proximate a center of the sole and a distal end located more proximate the toe, wherein the second channel has front and rear boundary edges, a trough, and front and rear side walls extending continuously inwardly from the front and rear boundary edges to the trough, wherein the front boundary edge junctures with a spacing portion extending from the front boundary edge to a peripheral edge of the face to form a smooth surface between the front boundary edge and the peripheral edge of the face, and the rear boundary edge junctures with the sole, wherein the first and second channels each have a width defined between the front and rear boundary edges, and the widths of the first and second channels are smaller at the proximal end and larger at the distal end, wherein the first and second channels are recessed with respect to portions of the sole located along the front boundary edge and the rear boundary edge, and proximate a center of the sole, wherein a wall thickness of the first channel and a wall thickness of the second channel are different from a wall thickness of an adjacent portion of the sole, wherein the front and rear side walls and the trough of the first channel are oriented to form angles with each other, and the front and rear side walls and the trough of the second channel are oriented to form angles with each other, and wherein the front boundary edges of the first and second channels extend generally parallel to the peripheral edge of the face, and the rear boundary edges of the first and second channels extend away from the face from the proximal end toward the distal end.

16. The golf club head of claim 15, wherein the wall thickness of the first channel and the wall thickness of the second channel is smaller than the wall thickness of the adjacent portion of the sole.

17. The golf club head of claim 15, wherein the width of each of the first channel and the second channel increases in a tapering configuration from the proximal end to the distal end.

18. The golf club head of claim 15, wherein a gap is defined between the proximal ends of the first and second channels, wherein a geometric centerline of the sole extends through the gap, and wherein the first and second channels are recessed with respect to portions of the sole located within the gap.

19. The golf club head of claim 18, wherein the sole has a smooth surface within the gap that forms a lowermost surface of the golf club head in use.

20. A golf club head comprising:

a face having an outer surface configured for striking a ball;

a body connected to the face and extending rearward from the face, the body including a heel, a toe, a top side, and a sole configured to confront a playing surface in use, wherein the body and the face combine to define an enclosed interior cavity;

a first inwardly recessed channel at least partially located on the sole of the body and being configured to influence an impact of a ball on the face, the first channel having a proximal end located more proximate a center of the sole and a distal end located more proximate the heel, wherein the first channel has front and rear boundary edges, a trough, and front and rear side walls extending continuously inwardly from the front and rear boundary edges to the trough, wherein the front boundary edge junctures with a spacing portion extending from the front boundary edge to a peripheral edge of the face to form a smooth surface between the front boundary edge and the peripheral edge of the face, and the rear boundary edge junctures with the sole; and a second inwardly recessed channel at least partially located on the sole of the body and being configured to influence the impact of the ball on the face, the second channel having a proximal end located more proximate a center of the sole and a distal end located more proximate the toe, wherein the second channel has front and rear boundary edges, a trough, and front and rear side walls extending continuously inwardly from the front and rear boundary edges to the trough, wherein the front boundary edge junctures with a spacing portion extending from the front boundary edge to a peripheral edge of the face to form a smooth surface between the front boundary edge and the peripheral edge of the face, and the rear boundary edge junctures with the sole, wherein the first and second channels each have a width defined between the front and rear boundary edges, and the widths of the first and second channels are smaller at the proximal end and larger at the distal end, wherein the first and second channels are recessed with respect to portions of the sole located along the front boundary edge and the rear boundary edge, and proximate a center of the sole, wherein a gap is defined between the proximal ends of the first and second channels, wherein a geometric centerline of the sole extends through the gap, and wherein the first and second channels are recessed with respect to portions of the sole located within the gap, and wherein the sole has a smooth surface within the gap that forms a lowermost surface of the golf club head in use.

* * * * *